US011661737B2

(12) United States Patent
Burnquist et al.

(10) Patent No.: US 11,661,737 B2
(45) Date of Patent: May 30, 2023

(54) MODULAR CONCRETE BUILDING BLOCK AND METHODS

(71) Applicant: Anchor Wall Systems, Inc., Minnetonka, MN (US)

(72) Inventors: Robert Brian Burnquist, Chaska, MN (US); Jonathan M. Schlueter, Medina, MN (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 0 days.

(21) Appl. No.: 17/739,529

(22) Filed: May 9, 2022

(65) Prior Publication Data

US 2022/0259853 A1 Aug. 18, 2022

Related U.S. Application Data

(63) Continuation of application No. 16/919,732, filed on Jul. 2, 2020, now Pat. No. 11,326,343.

(51) Int. Cl.
*E04B 2/36* (2006.01)
*E04B 2/02* (2006.01)

(52) U.S. Cl.
CPC ..... *E04B 2/36* (2013.01); *E04B 2002/0208* (2013.01); *E04B 2103/02* (2013.01)

(58) Field of Classification Search
CPC ..... E04B 2/36; E04B 2002/0208; E04B 2103/02; E04B 2/12; E04B 2/18; E04B 2/22; E04B 2002/0271
See application file for complete search history.

(56) References Cited

U.S. PATENT DOCUMENTS 3,390,502 A 7/1968 Carroll
4,035,975 A 7/1977 Gergely
(Continued)

FOREIGN PATENT DOCUMENTS

DE 1112822 B 8/1961
DE 2154496 A1 5/1972
(Continued)

OTHER PUBLICATIONS

International Search Report and Written Opinion for PCT/US2021/038224 dated Oct. 6, 2021, 19pgs.

*Primary Examiner* — Gisele D Ford
(74) *Attorney, Agent, or Firm* — Merchant & Gould P.C.

(57) ABSTRACT

A concrete block includes first, second, third, fourth, fifth, and sixth planar faces. The first and second faces are generally parallel, and the distance between the first and second faces define a thickness of the first block; the third and fourth faces are parallel to each other and perpendicular to the first and second faces; the fifth face is perpendicular to the first, second, third, and fourth faces; the sixth face: extends perpendicular to the third face; extends toward the fourth face and ends at a non-planar remainder section; is parallel to the fifth face; is contained in a plane that intersects a plane containing the third face; and a distance from the intersection to the remainder section is at least as long as the thickness of the first block; and the remainder section extends between the sixth face and the fourth face and has a shape such that when a second block of the same construction as the first block has its remainder section engaged against the remainder section of first block, the remainder sections of the first and second blocks mate.

19 Claims, 15 Drawing Sheets

(56) References Cited

U.S. PATENT DOCUMENTS

| | | | |
|---|---|---|---|
| 4,429,506 | A | 2/1984 | Henderson |
| 4,593,513 | A | 6/1986 | Stratton |
| 4,956,958 | A | 9/1990 | Caroti |
| D350,611 | S | 9/1994 | Scales |
| 6,233,897 | B1 | 5/2001 | Jurik |
| 6,253,518 | B1 | 7/2001 | Azar |
| 6,695,544 | B2 | 2/2004 | Knudson et al. |
| D584,423 | S | 1/2009 | Mugge |
| 7,849,656 | B2 | 12/2010 | Mugge et al. |
| 8,128,851 | B2 | 3/2012 | Scherer |
| 9,458,594 | B2 | 10/2016 | Brookhart et al. |
| 9,482,002 | B2 | 11/2016 | Johnson et al. |
| D829,934 | S | 10/2018 | Burnquist |
| 10,487,494 | B1 | 11/2019 | Miller et al. |
| 10,851,514 | B2 | 12/2020 | Burnquist |
| 2003/0014937 | A1 | 1/2003 | Azar |
| 2005/0144883 | A1 | 7/2005 | Hopson et al. |
| 2013/0118109 | A1 | 5/2013 | Haintze et al. |
| 2013/0333319 | A1 | 12/2013 | Zinser |
| 2014/0260059 | A1 | 9/2014 | Riccobene et al. |
| 2015/0063924 | A1 | 3/2015 | Brookhart et al. |
| 2016/0244936 | A1 | 8/2016 | Macdonald et al. |
| 2016/0346707 | A1 | 12/2016 | Kuo |
| 2019/0257054 | A1 | 8/2019 | Burnquist |
| 2019/0383005 | A1 | 12/2019 | Genest et al. |
| 2020/0181902 | A1 | 6/2020 | Lacas et al. |
| 2021/0238846 | A1 | 8/2021 | Zhang et al. |
| 2022/0002994 | A1 | 1/2022 | Burnquist et al. |

FOREIGN PATENT DOCUMENTS

| | | | |
|---|---|---|---|
| DE | 102010014041 | A1 | 12/2010 |
| WO | 2012040789 | A1 | 4/2012 |

MODULAR CONCRETE BUILDING BLOCK AND METHODS

CROSS REFERENCE TO RELATED APPLICATIONS

This application is a continuation of U.S. application Ser. No. 16/919,732, filed Jul. 2, 2020, issued as U.S. Pat. No. 11,326,343; application Ser. No. 16/919,732 is incorporated herein by reference.

TECHNICAL FIELD

This disclosure relates to modular concrete building blocks with decorative faces that can be used in many different ways, including, for example, to build walls, such as landscaping walls or freestanding walls, or to build columns and at-grade or above-grade edging strips. This disclosure also relates to methods for making the blocks and methods for using them.

BACKGROUND

Modular concrete building blocks can be used to build walls, including free-standing walls, retaining walls, and landscaping walls. These blocks can be used either by contractors or by individuals in the "do it yourself" market.

Improvements in building blocks, including the ease of assembling the blocks into various structures, and with a visually attractive result, are desirable.

SUMMARY

In one aspect, a first block is provided comprising first, second, third, fourth, fifth, and sixth planar faces, wherein; the first and second faces are generally parallel, and the distance between the first and second faces define a thickness of the first block; the third and fourth faces are parallel to each other and perpendicular to the first and second faces; the fifth face is perpendicular to the first, second, third, and fourth faces; the sixth face extends perpendicular to the third face, extends toward the fourth face and ends at a non-planar remainder section, is parallel to the fifth face, and is contained in a plane that intersects a plane containing the third face; a distance from the intersection to the remainder section being at as least as long as the thickness of the first block; and the remainder section extends between the sixth face and the fourth face and has a shape such that when a second block of the same construction as the first block has its remainder section engaged against the remainder section of first block, the remainder sections of the first and second blocks mate.

In examples, the length from the third face to the remainder section is equal to the thickness of the first block.

In examples, the remainder section includes a plurality of planar faces angled relative to each other at non-straight and non-zero angles.

In examples, the plurality of planar faces of the remainder section includes at least three planar faces.

In some examples, the plurality of planar faces of the remainder section includes at least five planar faces.

The remainder section includes a curved surface, in some examples.

In some examples, the curved surface includes at least one convexly curved surface and at least one concavely curved surface.

Some examples include at least the first face having false joint lines thereon.

In some embodiments, the third and fourth faces have false joint lines thereon.

In another aspect, a free-standing wall comprising a plurality of the first blocks as variously characterized above is provided. The wall comprises a first wall section including a base layer of the first blocks arranged side by side such that the first faces of the blocks are generally co-planar, the fifth face is against a base surface, and the sixth face and remainder section are facing up; and a first layer of second blocks, having the same construction as the first blocks, stacked on the base layer so that the sixth face of most of the second blocks is engaged against the sixth face of the first blocks in the base layer, and the remainder section of most of the second blocks is in mating engagement with the remainder section of the first blocks in the base layer.

The wall can further include a second wall section perpendicular to the first wall section; the second wall section having a base layer of the first blocks arranged side by side such that the first faces of the blocks in the second wall section are generally co-planar with each other and perpendicular to a plane containing the first faces of the first wall section; the second wall section having a first layer of the second blocks stacked on the second wall section base layer so that the sixth face of most of the second blocks in the second wall section is engaged against the sixth face of the first blocks in the base layer of the second wall section, and the remainder section of most of the second blocks in the second wall section is in mating engagement with the remainder section of the first blocks in the base layer in the second wall section; and wherein the sixth face one of the second blocks at a first end of the second wall section first layer is engaged against the sixth face of one of the first blocks at a first end of the first wall section base layer.

The wall can further include a third wall section perpendicular to the first wall section; the third wall section having a base layer of the blocks arranged side by side such that the first faces of the blocks in the third wall section are generally co-planar with each other and perpendicular to a plane containing the first faces of the first wall section; the third wall section having a first layer of the blocks stacked on the third wall section base layer so that the sixth face of each of the blocks in the third wall section first layer is engaged against the sixth face of the blocks in the third wall section base layer, and the remainder section of the third wall section first layer of blocks is in mating engagement with the remainder section of the third wall section base layer of blocks; and wherein the sixth face of one of the first blocks at a first end of the third wall section base layer is engaged against the sixth face of one of the second blocks at a second end of the first wall section first layer.

In another aspect, a first body piece is provided including planar first and second faces that are parallel, the distance between those faces defining the thickness of the first body piece; third and fourth planar side faces that are parallel to each other and perpendicular to the first and second faces; opposite fifth and sixth surfaces, with the first and second faces and third and fourth faces extending between the fifth and sixth surfaces; each of the fifth and sixth surfaces having an identical profile shape including: a planar section and a non-planar remainder section; the planar section extending from one of the third and fourth side faces and extending perpendicular to that side face toward the other side face ending at the remainder section; the planar section having a length as least as long as the thickness of the first body piece; the remainder section extending between the planar section and the other side face; the remainder section being formed such that when a second body piece of the same construction has its remainder section engaged against the remainder section of the first body piece, the remainder sections of the first and second body pieces mate.

In some examples, the planar section having a length equal to the thickness of the first body piece.

In some examples, the remainder section includes a plurality of planar faces angled relative to each other at non-straight and non-zero angles.

Some embodiments have the plurality of planar faces of the remainder section including at least three planar faces.

In some examples, there are at least the first and second faces with false joint lines thereon.

In another aspect, a free-standing wall is provided comprising: a first wall section including a base layer of first blocks as variously characterized herein, arranged side by side such that the first faces of the first blocks are generally co-planar; a first layer of body pieces as variously characterized herein stacked on the base layer so that the planar section of the sixth surface of each of the body pieces in the first layer is engaged against the sixth face of the first blocks in the base layer, and wherein the remainder section of the sixth surface of the first layer of body pieces is in mating engagement with the remainder section of the sixth face of the base layer of first blocks; and a second layer of body pieces stacked on the first layer so that the planar section of the fifth surface of each of the body pieces in the second layer is engaged against the planar section of the fifth surface of the body pieces in the first layer, and wherein the remainder section of the fifth surface of the second layer of body pieces is in mating engagement with the remainder section of the fifth surface of the first layer of body pieces.

Example embodiments further include a third layer of the first blocks of claim 1 stacked on the second layer of body pieces so that the sixth face of each of the first blocks in the third layer is engaged against the planar section of the sixth surface of the body pieces in the second layer, and wherein the remainder section of the third layer of first blocks is in mating engagement with the remainder section of the sixth surface of the second layer of body pieces.

In another aspect, a method of constructing a free-standing wall comprising a plurality of the first blocks as variously characterized herein; the method comprising: laying a base course of the first blocks arranged side by side such that the first faces of the blocks are generally co-planar, and the fifth face is against a base surface, and the sixth face and remainder section are facing up to create a first wall section; and laying a first layer of second blocks, having the same construction as the first blocks, stacked on the base course so that the sixth face of most of the second blocks is engaged against the sixth face of the first blocks in the base course, and the remainder section of most of the second blocks is in mating engagement with the remainder section the first blocks in the base course.

In examples, there is further a step of constructing a second wall section perpendicular to the first wall section by laying a base course of the first blocks arranged side by side such that the first faces of the blocks in the second wall section are generally co-planar with each other and perpendicular to a plane containing the first faces of the first wall section; and laying a first layer of the second blocks on the second wall section base course so that the sixth face of most of the second blocks in the second wall section is engaged against the sixth face of the first blocks in the base course of the second wall section, and the remainder section of most of the second blocks in the second wall section is in mating engagement with the remainder section the first blocks in the base layer in the second wall section; and wherein the sixth face one of the second blocks at a first end of the second wall section first course is engaged against the sixth face of one of the first blocks at a first end of the first wall section base course.

Example methods further includes steps of constructing a third wall section perpendicular to the first wall section by laying a base course of the blocks arranged side by side such that the first faces of the blocks in the third wall section are generally co-planar with each other and perpendicular to a plane containing the first faces of the first wall section; laying a first course of the blocks on the third wall section base course so that the sixth face of each of the blocks in the third wall section first course is engaged against the sixth face of the blocks in the third wall section base course, and the remainder section of the third wall section first course of blocks is in mating engagement with the remainder section of the third wall section base course of blocks; and wherein the sixth face of one of the first blocks at a first end of the third wall section base course is engaged against the sixth face of one of the second blocks at a second end of the first wall section first course.

In another aspect, a concrete construction block is provided comprising: a first face; a second face generally parallel to the first face; the block having a uniform thickness defined by a distance between the first face and second face; a third face extending between and perpendicular to the first and second faces; a fourth face parallel to the third face; the fourth face extending between and perpendicular to the first and second faces; a fifth planar face extending between and perpendicular to the first face, second face, third face, and fourth face; a sixth planar face, parallel to the fifth face; the sixth face extending perpendicular to the first face, second face, and third face and being contained within a plane extending from a plane containing the third face a distance as least as long as said thickness; an irregular section extending from the sixth face to the fourth face and perpendicular to the first face and second face; the irregular section including at least a first cavity and a first projection; the first cavity being recessed from an imaginary plane in a direction toward the fifth face; said plane being co-planar with the sixth face; the first projection extending from said plane in a direction away from a remainder of the block; and the first cavity and the first projection have the same first perimeter shape.

In some embodiments, the irregular section further includes a second cavity and second projection; the second cavity being recessed from the imaginary plane in a direction toward the fifth face; the second projection extending from said imaginary plane in a direction away from a remainder of the block; and the second cavity and the second projection have the same second perimeter shape.

In some examples, the sixth face extends from the third face a distance equal to the thickness.

In some examples, the second projection is between the first cavity and second cavity.

In some embodiments, the first and second cavities alternate with the first and second projections along the irregular section.

In some examples, the perimeter first shape is curved.

In some examples, the perimeter first shape is polyhedral.

In some examples, the perimeter first shape is polyhedral; and the perimeter second shape is polyhedral.

Some embodiments include at least the first and second faces having false joint lines thereon.

For some examples, the third and fourth faces have false joint lines thereon.

In another aspect, a free-standing wall comprising a plurality of the blocks as variously characterized herein is provided. The wall comprises a first wall section including a base layer of the blocks arranged side by side such that the first faces of the blocks are generally co-planar, the fifth faces are facing down against a base surface, and the sixth faces and irregular sections are facing up; and a first layer of the blocks stacked on the base layer so that the sixth face of most of the blocks in the first layer is engaged against the sixth face of the blocks in the base layer, and the irregular section of most of the blocks in the first layer is in mating engagement with the irregular sections of the blocks in the base layer.

A variety of examples of desirable product features or methods are set forth in part in the description that follows, and in part will be apparent from the description, or may be learned by practicing various aspects of this disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

A. Molded Concrete Blocks—Generally

While the techniques described herein were particularly developed for use with concrete blocks made by a dry-cast process, various ones of the techniques described can be applied to concrete blocks formed by wet cast processes, concrete press processes, concrete extrusion processes, 3D concrete printing processes, and other processes.

The concrete blocks of particular interest here are generally ones that are mass-produced, and are molded having at least one face or face section molded into a configuration such that the block can be used, together with other such blocks, to create a structure that simulates a wall or wall section made from stone masonry, i.e. to simulate the appearance of many discrete and differentiated stone pieces secured to one another with mortar or similar material. To facilitate this, the blocks are molded with a face or face section that has: visually distinct section(s) with features emulating stone pieces (false stone sections); and, various grooves between those distinct sections that simulate the appearance of joints and/or mortar sections between individual stones (false joints), in spite of the blocks actually having an integral structure and not comprising individual pieces. The blocks can also have a face or face section with various other types of topology to give a craggy appearance, or other types of three-dimensional (positive/negative topology) features, molded in to create a visually attractive appearance. Techniques applicable to mold such blocks are known. In the context of dry-cast concrete blocks, the molding techniques are described, for example, in U.S. Pat. No. 8,128,851, incorporated herein by reference.

Herein, the terms "molded block", "molded block unit" and variants thereof, are meant to refer to a single unitary molded block structure, without specific regard to the method of manufacture (other than molding having been used). The term "dry-cast concrete block" and variants thereof, is meant to specifically reference a block that has been made from a dry-cast concrete process as opposed to a wet-cast concrete process.

B. Example Block Types and Features—FIGS. 1-6, 10-13, 18, 21 and 22

It is noted that a concrete block can be characterized by its features "as made"—that is, as the block is oriented within the mold and when removed from the "mold" on a standard dry-cast production line-; or "as installed"—that is, as the block is oriented when installed in a wall or other structure in use.

Figure 1:
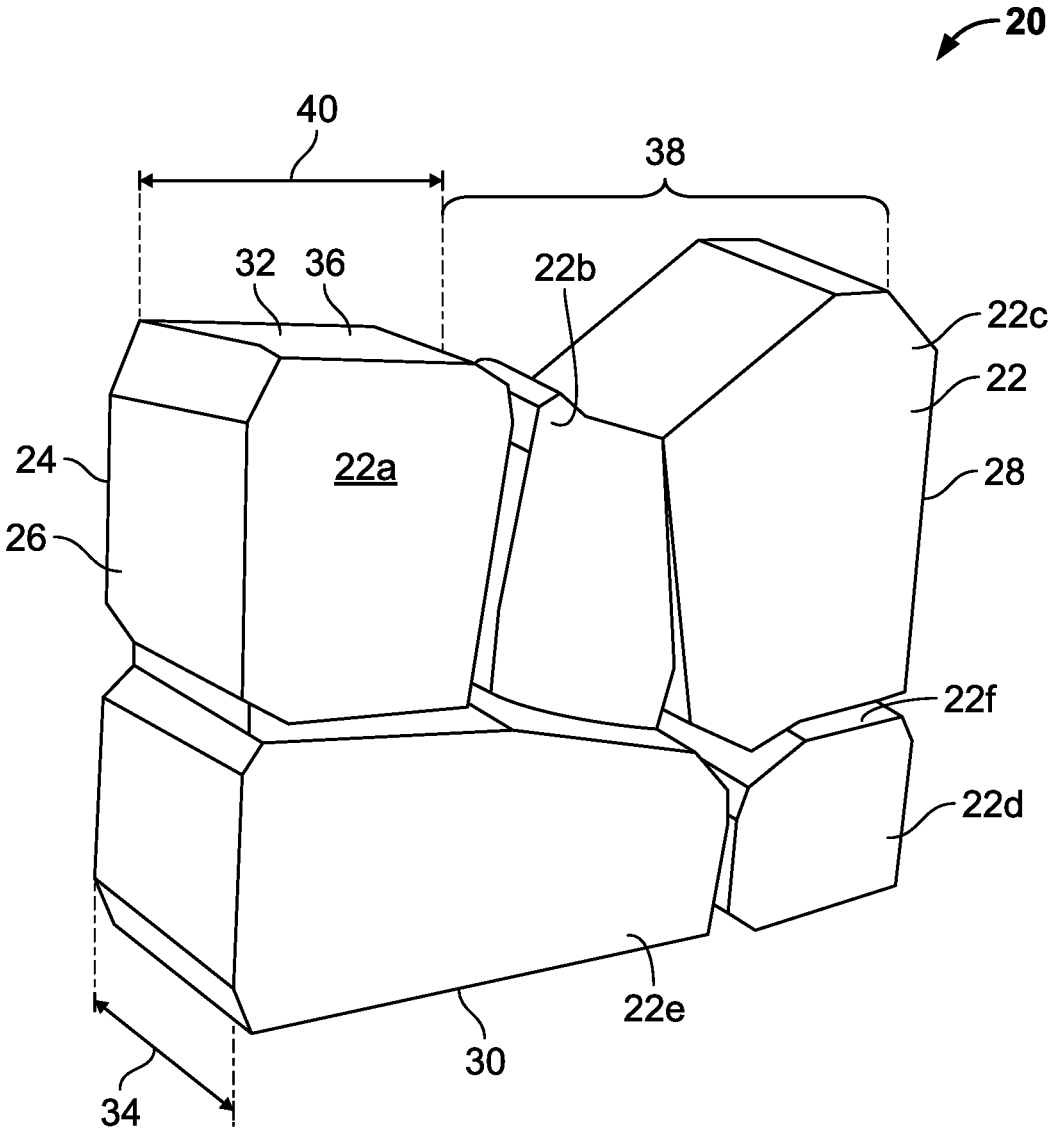
FIG. 1 is a perspective view of an embodiment of a concrete block, constructed in accordance with the principles of this disclosure.
Figure 2:
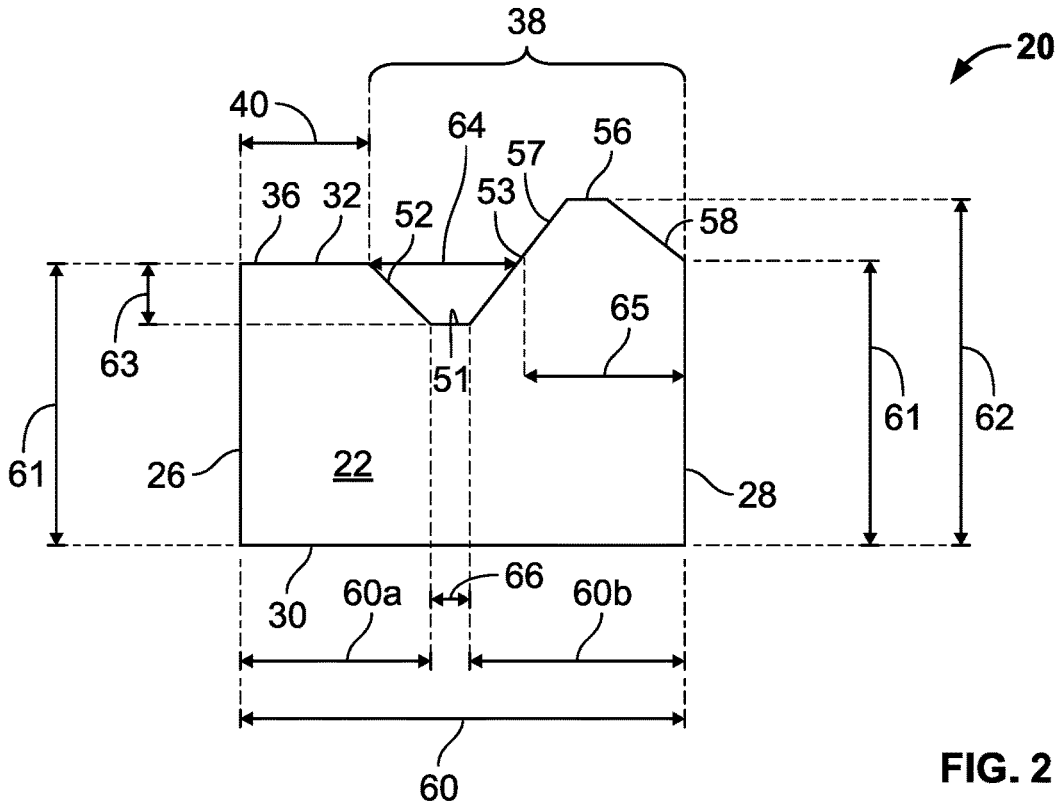
FIG. 2 is a front, elevation view of an embodiment of a block similar to the block of FIG. 1 and showing the general outer perimeter shape.

FIG. 1 generally indicates an example concrete block constructed in accord with the present disclosure. Slight variations between what is depicted in FIG. 1 and FIG. 2 can be seen, but FIG. 1 is similar to what is shown in FIGS. 2-6, 10-13, 18, 21 and 22, such that the same reference numerals are used for similar parts. The concrete block 20 includes a first face 22 referenced herein as the "first face, or a front, decorative, face" or by similar terms. This is the face of the block 20 that, when the block is used to form a structure such as a wall, decorative feature, or retaining wall, primarily faces a viewer in front of the wall. It is also preferably a face that is visually enhanced in accord with the present techniques.

Opposite the first face 22 is a second face 24, which is generally referred to herein alternatively as a "back or rear" face. When the block 1 is made in a "dry-cast" mold process, it is typically constructed with front face 22 being directed upwardly and rear face 24 being a bottom surface or downwardly directed surface. When removed from the mold, as a green block for transportation to a curing station, the block is typically oriented resting on the machine pallet with surface 24 down (against the pallet) and face 22 up.

Blocks, such as block 20, generally include third and fourth opposite faces 26, 28 that, in use in a wall or other structure, are the left and right sides extending between the first face 22 and second face 24. The block 20 also includes a fifth (bottom) face 30 and sixth (top or upper) face 32 each extending between surfaces 22, 24 and surfaces 26, 28.

Still referring to FIG. 1, the first face 22 is decorative and can be seen as having visually distinct false stone sections 22*a*, 22*b*, 22*c*, 22*d* and 22*e* separated by groove or false joint sections 22*f*. These groove sections 22*f* are molded sections that cause the appearance of the separate sections 22*a*-22*e*, to simulate an appearance in the face 22 of a resulting construction from a masonry process in which separate stones (the appearance of which is created by the sections 22*a*-22*e*) are joined together by mortar to form the resulting structure. Techniques for creating such sections and grooves are described for example in such references as U.S. Pat. No. 8,128,851.

Herein, visually distinct sections such as 22*a*-22*e* will sometimes referred to as "false stone sections." By this term it is not meant to be suggested that the sections are actually separate, but rather they are sections that create the appearance of separate stones having been used in the resulting wall or other structure. Sections such as 22*f* will be sometimes referred to as "false mortar sections" or "false joints." By such terms it is not meant that the sections actually include mortar, but rather the molded sections that create the appearance of mortar between the false stone sections. The decorative face 22 can also have a face that does not include the visually distinct false stone sections and/or false joints; such alternative decorative faces 22 can be any of a variety of appearances including non-limiting flat faces, bumpy faces, or a combination of flat and bumpy faces with or without the use of false joints.

It is noted that in some instances portions of the third and fourth faces 26, 28 can be provided with molded decorative features to facilitate the appearance of stone sections and/or mortar sections around a corner. This may be particularly desirable in blocks that are to be used as corner blocks in a wall or other construction.

In FIG. 2, a schematic front elevation view of an embodiment of the block 20 is depicted, with the first face 22 being shown, but without the decorative nature of the face 22 depicted. When the block 20 is a dry-cast block, generated in a mold and removed therefrom on a pallet, in a typical dry-cast process, the first face 22 is upwardly directed, i.e., as an upper ("as made") face in the uncured or green block. However, when the block is used in a wall, first face 22 is generally a lateral face, with sixth face/upper face 32 directed upwardly and fifth face/bottom face 30 directed downwardly. Since first face 22 is the decorative face, it is generally oriented in the resulting wall or other structure toward the viewer.

In FIG. 2, the block 20 is depicted having an outer perimeter shape in which the third and fourth faces 26, 28 are parallel; and the fifth (bottom) face 30 is perpendicular to the third and fourth faces 26, 28. In general, the first face 22 is generally parallel to the second face 24. That is, by "generally parallel", it is meant that even though the first face 22 can be decorative with false stone sections or other non-flat shapes, a plane from which the decorative face projections project in the first face 22 is parallel to the second face 24, and the distance 34 (FIG. 1) between the first face 22 and second face 24 defines the thickness of the block 20.

The first face 22, second face 24, third face 26, fourth face 28, fifth face 30, and sixth face 32 are planar faces. In this context, the term "planar" means that the faces can have some projections and/or recesses, but the overall visual impression is generally planar in that most of the outermost projections are contained within the same general plane. For example, even though the first face 22 can be decorative with false stone sections, it is considered planar since most of the outermost projections are contained within the same plane. As can be seen in FIG. 2, the sixth face 32 is contained in a plane that intersects a plane containing the third face 26.

Still in reference to FIG. 2, the sixth/upper face 32 has a first section 36 that extends from and is perpendicular to the third face 26. The first section 36 is parallel to the fifth (bottom) face 30 and extends from the third face 26 toward the fourth face 28 and ends at a remainder section 38. The remainder section 38 is also referred to herein as an "irregular section 38", as it can have a perimeter with an irregular shape. The first section 36 has a length 40 from the third face 26 to the remainder section 38 that is as least as long as the distance 34 defining the thickness of the block 20. In FIG. 2, the length 40 is equal to a distance from an intersection of the planes containing the sixth face 32 and third face 26 to the remainder section 38. In many arrangements, the length 40 is equal to the thickness. This relationship leads to advantages when constructing structures (e.g. walls, columns, etc.) with corners, as described further below.

The remainder section 38 extends between the first section 36 of the sixth face 32 and the fourth face 28 and is perpendicular to the first (front) face 22 and second (back) face 24. The perimeter surface of the remainder section 38 is shaped such that when a second block of the same construction as the block 20 has its remainder section 38 engaged against the remainder section 38 of the original block 20, the remainder sections 38 of the two blocks mate or mateably engage one another.

Figure 18:
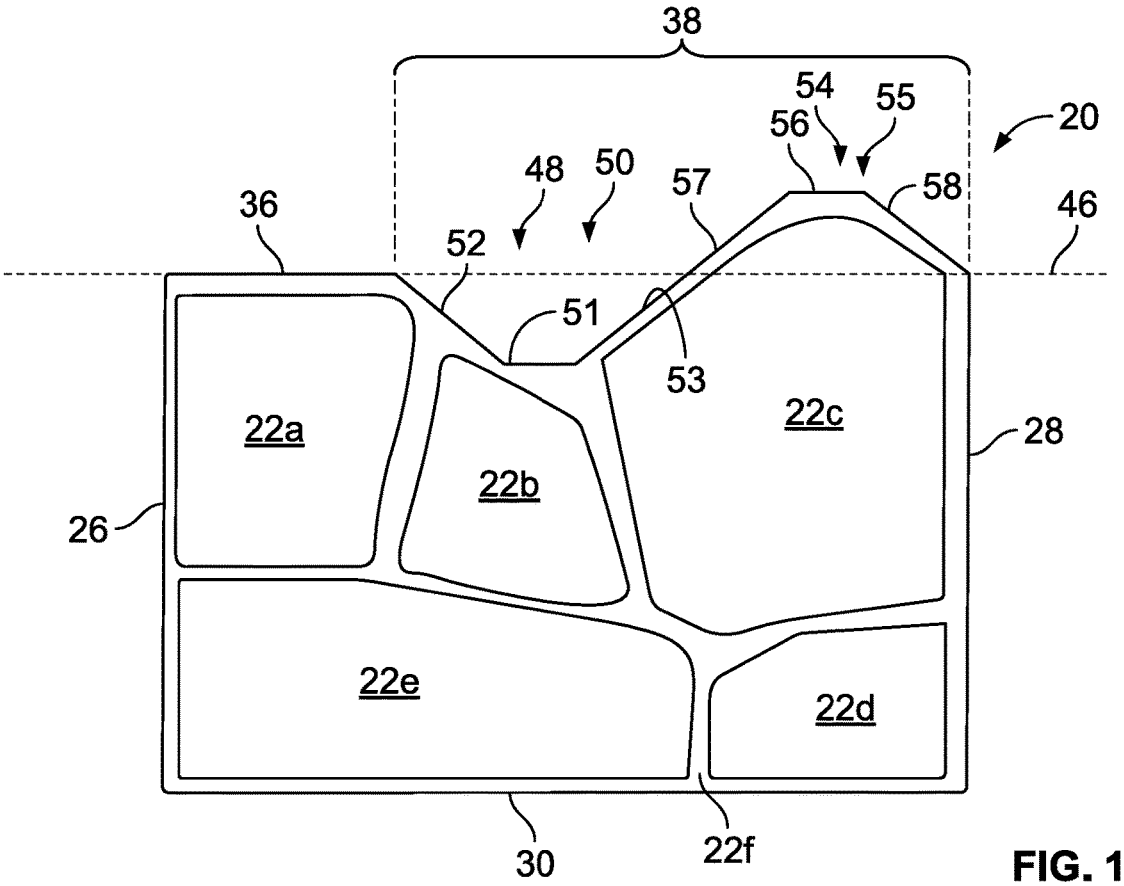
FIG. 18 is a front elevation view of the block of FIG. 2 showing the perimeter shape and additional definitions.

Attention is directed to FIG. 18. FIG. 18 shows the block 20 of FIG. 2 in front elevation view with false stones and false joints. The remainder section/irregular section 38 can be seen extending from the first section 36 of the top face 32. Also depicted in FIG. 18 is the broken line of a plane at 46. The plane 46 is parallel to the fifth face/bottom 30 and perpendicular to planes containing the third face 26 and fourth face 28. The plane 46 contains within it (i.e., is co-planar with) the first section 36 of the sixth/top face 32.

The remainder/irregular section 38 includes at least a first cavity 48 that is recessed from the plane 46. The first cavity 48 forms a depression or recess from the plane 46 in a direction toward the fifth face/bottom 30. While many different embodiments are possible, in the example shown, the first cavity 48 has a perimeter shape of a trapezoid 50. The parallel portions of the trapezoid 50 include section 51 of the irregular section 38 of the block 20 and the plane 46. Extending between the parallel section 51 and plane 46 are inclines or ramps 52, 53. The ramp is slanted downward and away from the first section 36 ending at the section 51. The section 51 is generally parallel to the fifth face/bottom 30. The ramp 53 is slanted or angled upward and away from the section 51 to the plane 46.

The remainder or irregular section 38 further includes at least a first projection 54. The first projection 54 extends or projects from the plane 46 in a direction away from the rest of the block 20. The first projection 54 has a perimeter shape 55. The perimeter shape 55 is the same shape as perimeter shape 50 of the first cavity 48. In this example embodiment, the perimeter shape 55 of the first projection is trapezoidal, as described above with respect to perimeter shape 50. The perimeter shape 55 in the form of a trapezoid includes parallel section 56, which is parallel to the fifth/bottom face 30 and the plane 46. It is also parallel to the section 51 and section 36 along the top face 32. Extending between parallel section 56 and plane 46 is ramp 57. Ramp 57 forms a continuous planar surface with the ramp 53. Extending from the parallel section 56 is ramp 58, which extends downward and away from parallel section 56 to the fourth face 28.

Because of the shape of the irregular section 38, including the symmetry between the perimeter shape 50 of first cavity 48 and perimeter shape 55 of the first projection 54, the block 20 can be mateably engaged or fitted together with a second block 20 of the same construction.

In other embodiments, as will be explained further below, there can be additional cavities and projections along the irregular section 38, and the perimeter shapes of the projections and cavities can be alternatively shaped including polyhedral shapes, curved shapes, and combinations of polyhedral and curved shapes.

In FIG. 2, it can be seen how in this embodiment, the remainder/irregular section 38 includes a plurality of planar faces relative to each other at non-straight and non-zero angles. The plurality of planar faces can include at least three planar faces, and in the embodiment shown in FIG. 2, at least five planar faces. In FIG. 2, the planar faces include, starting at the end of the first section 36: ramp 52, parallel section 51, ramp 53 together with ramp 57, parallel section 56, and ramp 58. Ramp 58 ends at fourth face 28. In other embodiments, there can be more or fewer faces in the remainder section 38, or the parts of the remainder section can be curved.

The block 20 of FIG. 2 can be many different sizes. In FIG. 2, example dimensions are indicated. An example length of the block 20 from third face 26 to the fourth face 28 shown at reference numeral 60 is at least 10 inches, not greater than 20 inches, and about 14 inches. The distance 60*a* from the third face 26 to the section 51 is about 5-6 inches, while the distance 60*b* between the fourth face 28 to the section 51 is greater than 60a, at about 6-7 inches. The height of the block 20 at 61 between the bottom face 30 and first section 36 of the top face 32 is at least 5 inches, no greater than 15 inches, and in one example about 9 inches. The height 62 between the bottom face 30 and section 56 of the first projection 54 is at least 6 inches, no greater than 16 inches, and in one example about 10-11 inches. The thickness 34 shown in FIG. 1, which is the same as length 40 of the first section 36 of the top face 32 is at least 3 inches, no greater than 10 inches, and in one example about 4 inches. The depth of the first cavity 48 shown at 62 is at least 0.5 inch, no greater than 3 inches, and one example about 1-2 inches. The depth 63 is the same as the height of the first projection 54. The distance 64 along the plane 46 from where the first section 36 ends to where the plane 46 intersects the end of the ramp 53 and the beginning of the ramp 57 is at least 3 inches, no greater than 7 inches, and in one example about 5 inches. This distance 64 is also the same as distance 65, which is the distance of the plane 46 from where the ramp 53 ends and ramp 57 begins to where the ramp 58 ends at the fourth face 28. A length 66 of the section 51 between ramps 52 and 53 is at least 0.5 inch, no greater than three inches, and in one example about 1 inch.

Figure 3:
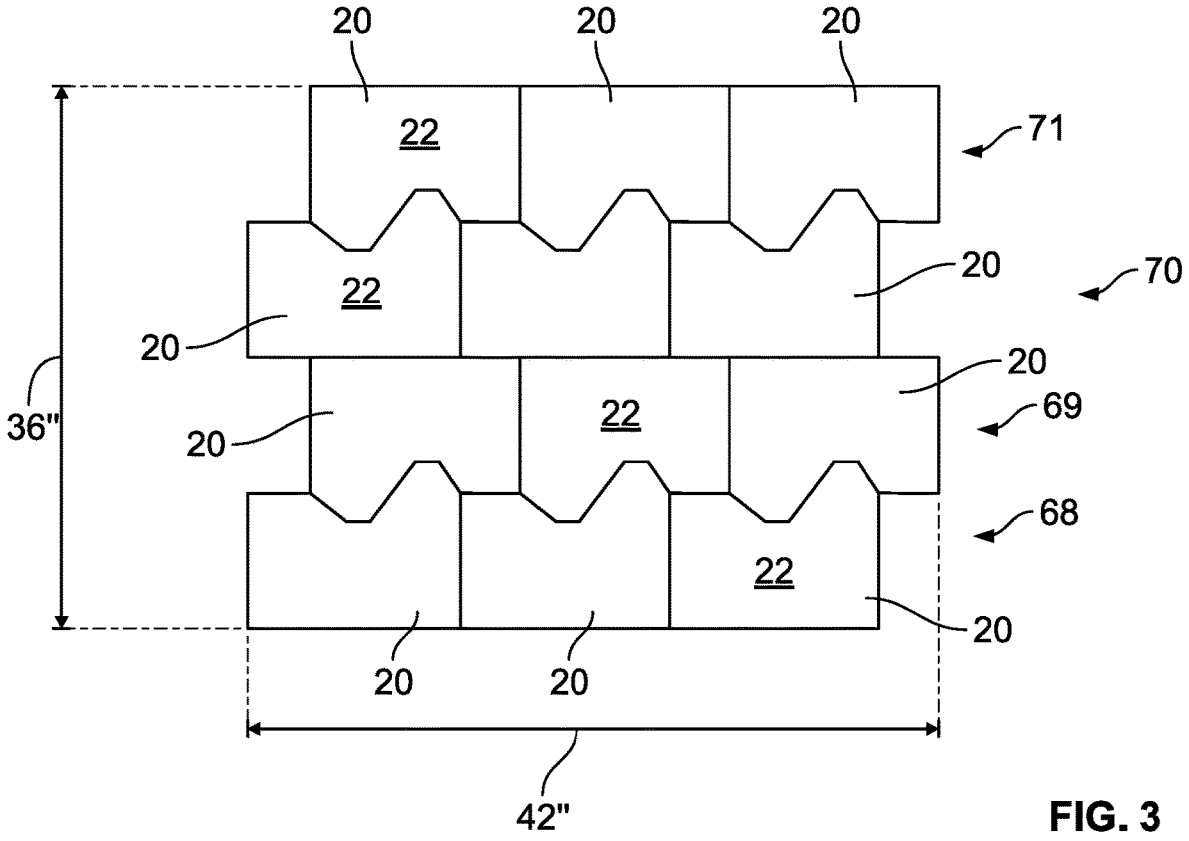
FIG. 3 is a top, plan view of the blocks of FIG. 2 as laid out on a pallet for shipping, in which the blocks are laid on their back face.

FIG. 3 illustrates the blocks 20 as laid out on a pallet, for example after molding and curing. The blocks 20 are shown as they would be arranged on the pallet, resting on their back faces 24 with the front faces 22 facing upward. In this example, the pallet has a size of about 42 inches by 36 inches and holds four rows of 3 blocks 20 each.

It can be see how the bottom row 68 of blocks 20 are arranged end to end, with the fourth face 28 against the third face 26 of the next adjacent block. In the second row 69, the blocks 20 are also end to end, but the remainder sections 38 of the blocks 20 in the second row are engaged against the remainder sections of 38 of the first row. The projections 54 in the remainder sections 38 of the first row 68. The third row 70 is shown oriented in the same configuration as the first row 68, and the fifth face/bottom 30 of the blocks 20 in the third row 70 are against the bottoms 30 of the second row 69. The fourth row 70 is oriented in the same way as the second row 69, with the remainder sections 38 of the fourth row 71 mateably engaging the remainder sections 38 of the third row 70.

Figure 4:
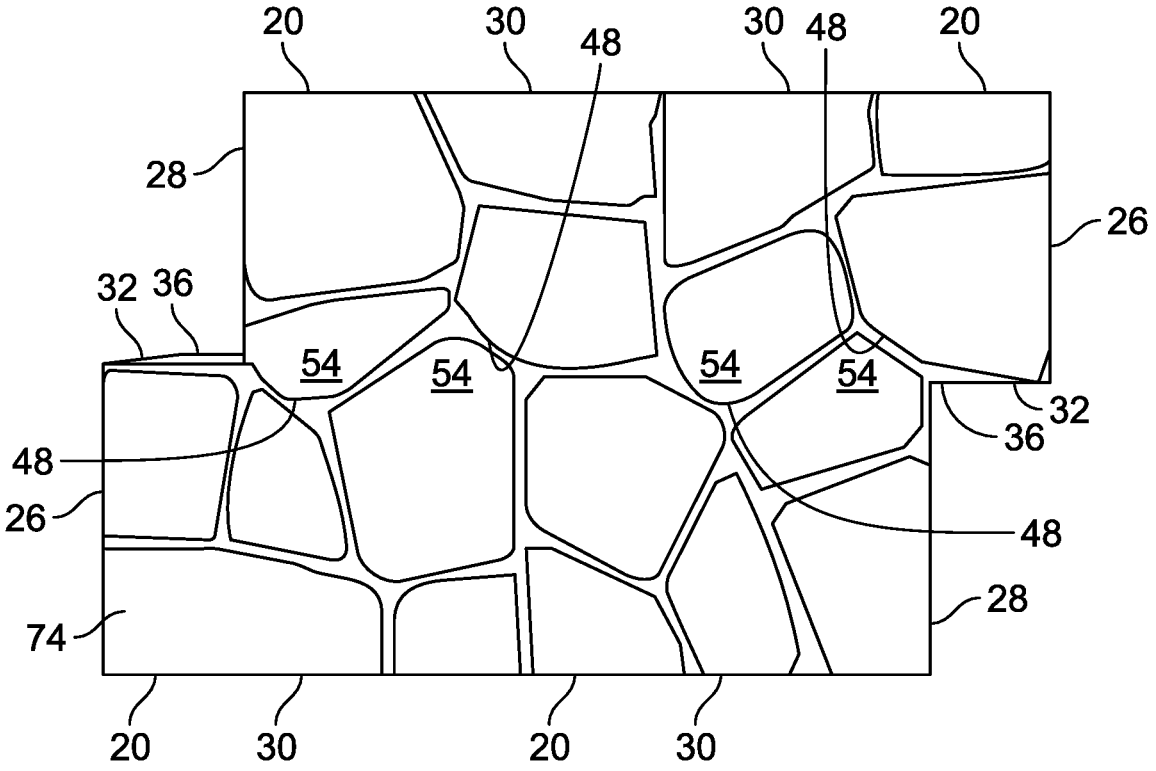
FIG. 4 is a front, elevation view of four of the blocks of FIG. 2 connected together.

FIG. 4 is a front elevation view of four of the blocks 20 of FIG. 2 mated together. As can be seen, the shape of the remainder section/irregular section 38 is such that when block 20 of the same construction has its remainder section/irregular section 38 engaged against the remainder section/irregular section 38 of the first block, the two remainder sections 38 mateably engage. By mateably engaged, in this example, it means that the first projection 54 of the blocks 20 in the upper layer are received by the first cavities 48 of the blocks 20 in the lower layer; and the first projections 54 of the blocks 20 in the lower layer are received by the first cavities 48 of the blocks 20 in the upper layer. The first section 36 of the sixth face 32 of the end block 74 in the bottom layer is open and exposed. It is available for receiving a block 20 in the upper layer either oriented 90° to it, to form a corner, or straight alongside, to form another length in the wall. Because the length 40 of the first section 36 is the same as the thickness 34 of the block 20, the block 20 is advantageously shaped for forming corners.

Figure 5:
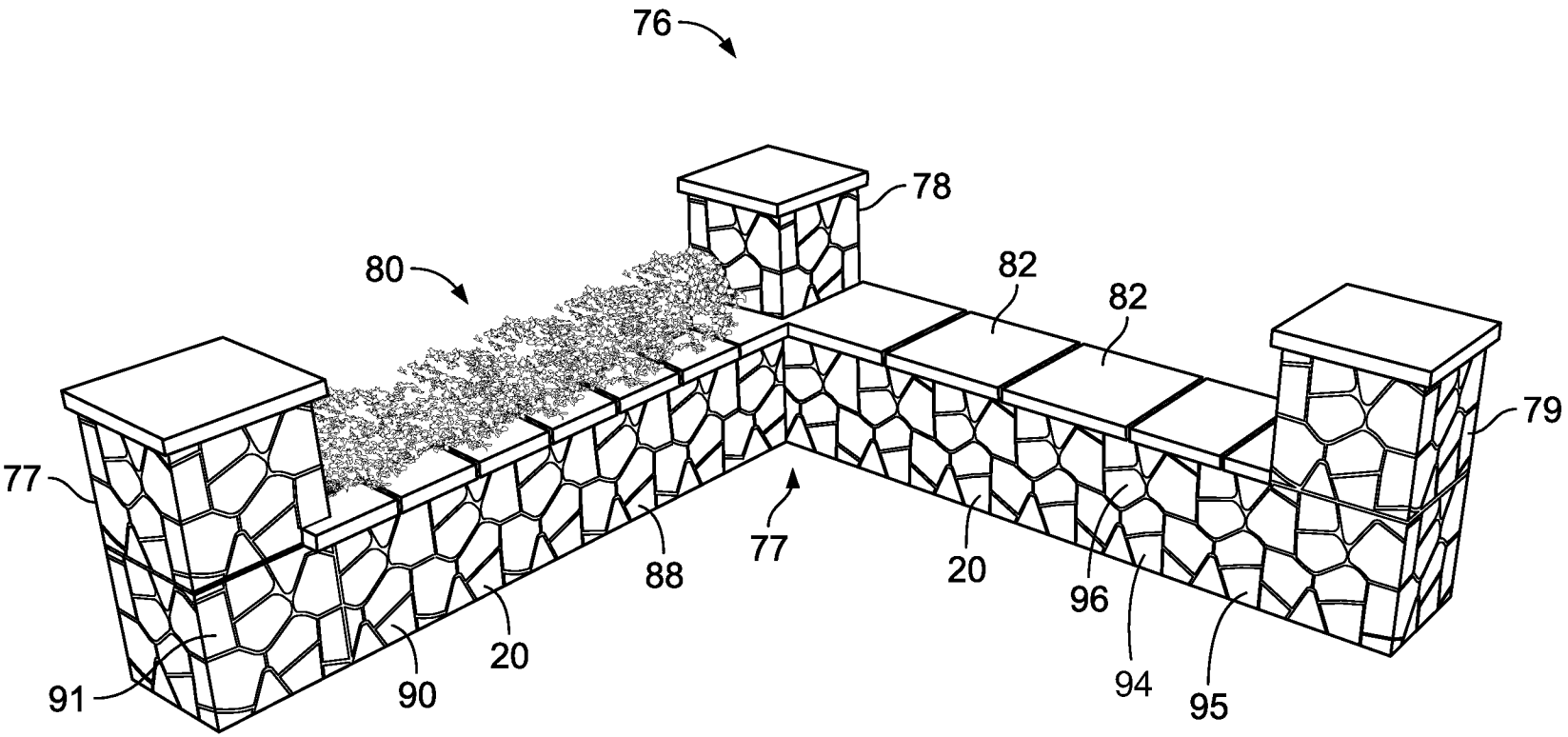
FIG. 5 is a perspective view of an example embodiment of structures that can be constructed from the block of FIG. 2, the example shown in FIG. 5 as columns, landscaping walls, and a planter.
Figure 6:
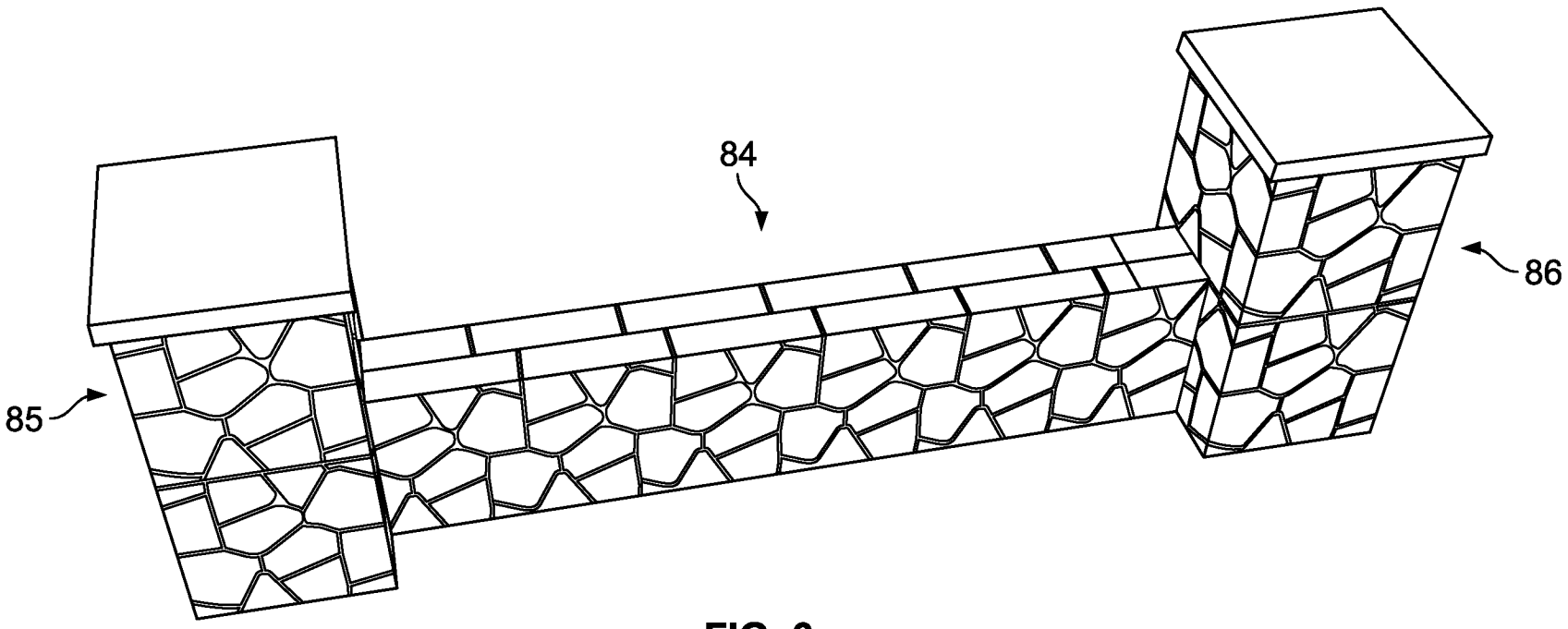
FIG. 6 is a perspective view of a back-to-back wall with columns constructed from the block of FIG. 2.

FIGS. 5 and 6 show some example structures that can be made from the block 20. A variety of structures are possible including free standing walls, walls with inside and outside corners, benches, garden walls, planters, tables, bars, fencing, columns, outdoor living areas, mailbox inserts, fire pits, benches with columns, planters and columns, decking over short columns, etc. In FIG. 5 is a construction 76 made from the blocks 20 having three columns 77, 78, 79. A pair of parallel facing walls extend between columns 77 and 78, and between the walls is a section 80 which can hold plants. A pair of parallel walls capped with cap blocks 82 extend between columns 78 and 79, and can form a seating area.

In FIG. 6, is a back-to-back wall 84 between two columns 85, 86. Each of the columns 85, 86 and wall 84 are constructed from the blocks 20.

In reference to FIG. 5, the construction 76 includes the planted section 80, which is a pair of parallel facing walls, one of which is shown at 88. In between the walls 88 plants may be placed. The wall 88 is constructed by forming a base course/layer 90 along the ground, with the blocks 20 arranged side by side, such that the first faces 22 of the blocks 20 are generally co-planar, the fifth face 30 is against the ground, and the sixth face 32 with the remainder section 38 is facing up. A first course/layer 91 of the blocks 20 (referred to herein as "second blocks 20) are stacked on the base course 90 so that the sixth face 32 of most of the second blocks 20 in the first course 91 are engaged against the sixth face 32 of the blocks 20 in the base course 90. The remainder section 38 of most of the second blocks 20 is in mating engagement with the remainder section 38 of the blocks in the base course 90.

Still in reference to FIG. 5, the construction 76 has a corner 77, in which there is a second wall section 94 perpendicular to the wall 88. The second wall section 94 has a base course 95 of the blocks 20 arranged side by side such that the first faces 22 of the blocks 20 in the second wall section 94 are generally co-planar and perpendicular to a plane containing the first faces 22 of the wall 88.

The second wall section 94 has a first course 96 of the blocks 20 (called "second blocks 20") stacked on the second wall section 94 base layer 95 so that the sixth face 32 of most of the second blocks 20 in the second wall section 94 is engaged against the sixth face 32 of the first blocks 20 in the base layer 95 of the second wall section 94, and the remainder section 38 of most of the second blocks 20 in the second wall section 94 is in mating engagement with the remainder section 38 of the blocks 20 in the base layer 95 of the second wall section 94. The sixth face 32 of one of the blocks 20 at a first end 98 of the second wall section 94 first layer 96 is engaged against the sixth face 32 of one of the blocks 20 at the first end 98 of the base layer 90 of the first wall section 88.

In the embodiment of FIG. 5, the wall sections 88 and 94 are shown as having only a base course and first course of the blocks 20, but in other embodiments, there can be further layers, as further shown in FIG. 10, described below. The columns 77, 78, and 79 have two additional courses arranged in the same manner as the base course and first course.

In FIG. 6, the back-to-back wall 84 is constructed like the wall 88 of FIG. 5, except that there is no space between the parallel walls; rather the parallel walls 101, 102 are engaged back-to-back between the columns 85, 86.

Figure 10:
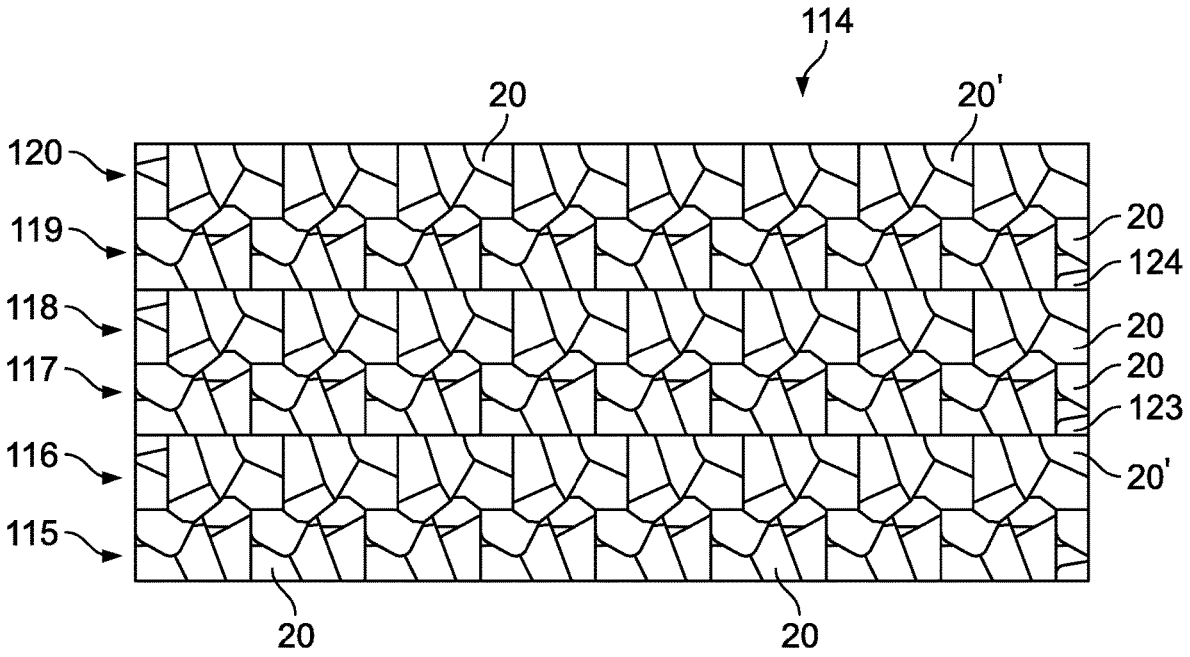
FIG. 10 is a front elevation view of the blocks of FIG. 7 arranged in a wall construction.

FIG. 10 is the front view of a wall section 114 that can be constructed of the blocks 20. In the embodiment of FIG. 10, there are six layers of the blocks 20, shown at courses or layers 115, 116, 117, 118, 119, and 120.

Figure 11:
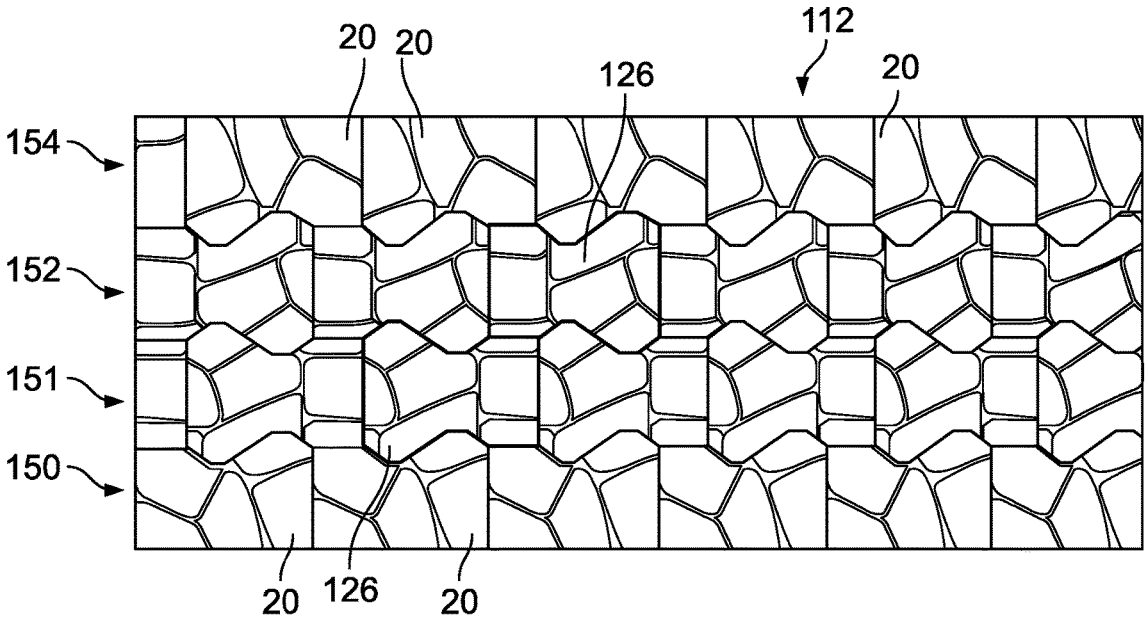
FIG. 11 is another wall construction using the blocks of FIG. 2, and also with a body piece, shown in FIGS. 12 and 13.
Figure 12:
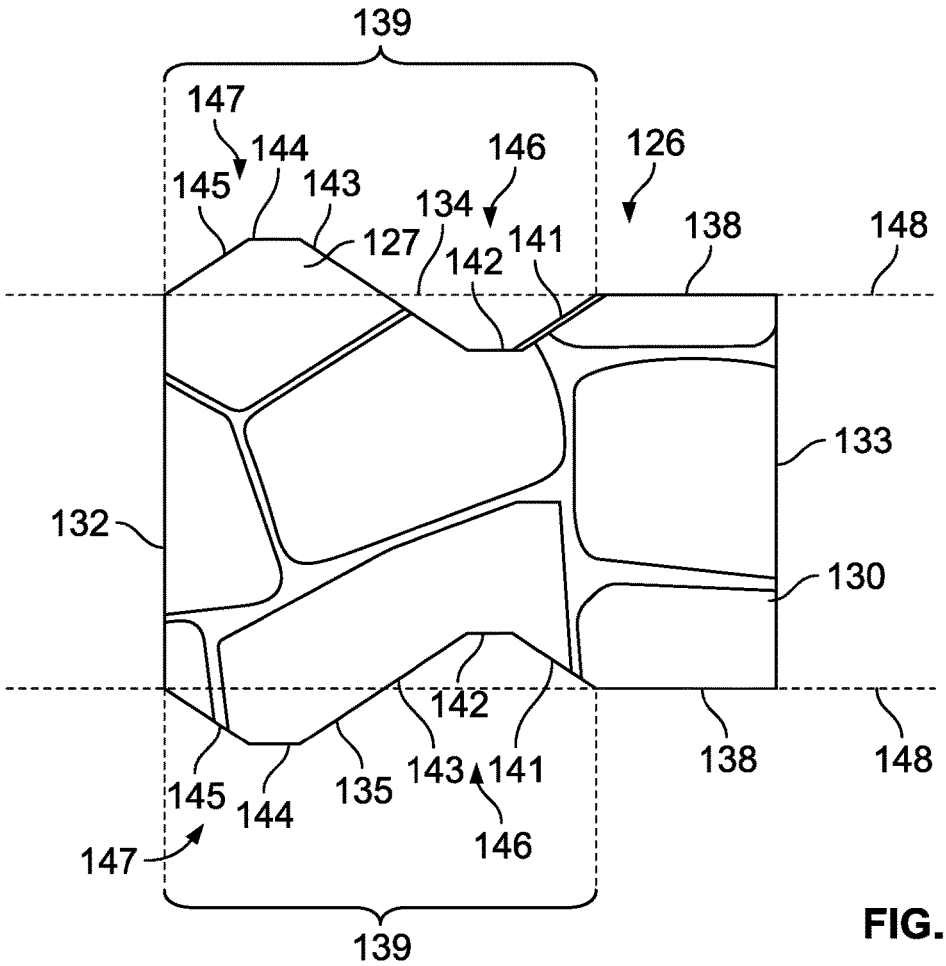
FIG. 12 is a front elevation view of a body piece usable with the block of FIG. 2 in constructing the wall of FIG. 11.

FIG. 11 is another wall section 122 constructed with the blocks 20. The difference between wall section 122 and wall section 114 is the existence of seams in the wall section 114. In the wall section 114, there are seams 123, 124 between every two layers of the wall section 114. For example, there is a seam 123 between layer 116 and 117, and there is a seam 124 between layers 118, and 119. In the wall section of 122 of FIG. 11, there are no seams. This is because the wall section 122 is made with the blocks 20 in addition to the use of body pieces 126 (FIGS. 12, 13, 21 and 22). In FIG. 11, the perimeters of some of the blocks 20 and body pieces 126 are bolded so that they can be more easily seen.

In FIGS. 12, 13, 21, and 22, the body piece 126 includes first and second faces 127, 128. The faces 127, 128 are parallel and can be generally planar. By "generally planar," it is meant that any crags, indents, projections, or cavities, do not project or recess greatly, such as no more than 1 inch.

Figure 21:
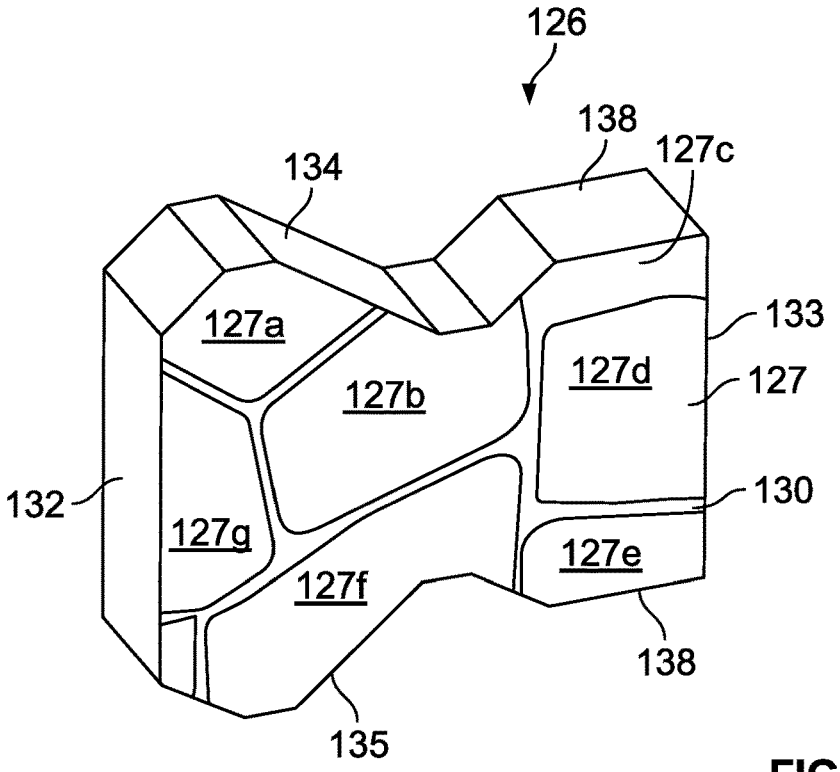
FIG. 21 is a perspective view of the body piece of FIG. 12.
Figure 22:
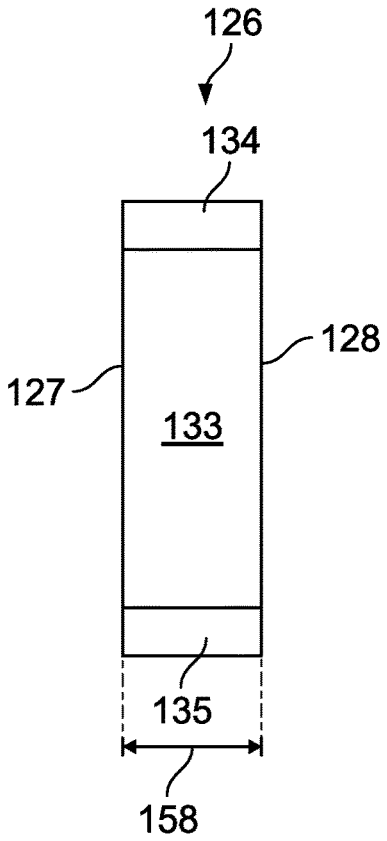
FIG. 22 is an end view of the body piece of FIGS. 12 and 21.

In FIG. 21, the first face 127 is shown to have false joint lines 130, dividing the first face 127 into visually distinct false sections 127*a*, 127*b*, 127*c*, 127*d*, 127*e*, 127*f*, and 127*g*. These false stone sections 127*a*-127*g* are separated by the false joint lines 130 to cause the appearance of separate sections 127*a*-127*g*, to simulate an appearance in the face 127 of a resulting construction from a masonry process in which separate stones are joined together by mortar to form the resulting structure.

The distance between the first and second faces 127, 128, defines the thickness of the body piece 126. The body piece 126 further includes third and fourth planar side faces 132, 133 that are parallel to each other and perpendicular to the first end second faces 127, 128.

Fifth and sixth faces 134, 135 are opposite to each other. The first and second faces 127, 128 and third and fourth faces 132, 133 extend between the fifth and sixth faces 134, 135. Each of the fifth and sixth faces 134, 135 have an identical profile shape to each other. The profile shape for each of the faces 134, 135 is described below using the same reference numbers.

In the example embodiment, the profile shape of faces 134, 135 includes at least a planar section 138 and a non-planar remainder section 139. The planar section 138 extends from fourth side face 133 and extends perpendicular to side face 133 toward the third side face 132 ending at the remainder section 139.

The planar section 138 has a length that is as least as long as the thickness of the first body piece 126, and can be equal to the thickness. The non-planar remainder section 139 is formed such that when a second body piece 126 of the same construction has its non-planar remainder section 139 engaged against the non-planar remainder section 139 of the first body piece 126, the non-remainder sections 139 of the first and second body pieces 126 mateably engage.

In the example shown, which is designed for use with blocks 20, the non-planar remainder section 139 of the body piece 126 includes a plurality of planar faces/surfaces angled relative to each other to form ramps at non-straight and non-zero angles. There can be at least three planar faces, and in the example shown in FIG. 12, there are five ramps 141, 142, 143, 144, 145. Still in reference to FIG. 12, the non-planar remainder section 139 of each of the fifth and sixth faces 134, 135 includes a first cavity 146 and a first projection 147. The first cavity 146 is recessed from a plane 148 that is co-planar with the planar section 138, and the first cavity 146 is recessed in a direction toward the opposite face. That is, in the fifth face 134, the first cavity 146 is recessed toward the sixth face 135, while in the sixth face 135, the first cavity 146 is recessed toward the fifth face 134.

The first projection 147 extends from the plane 148 that is co-planar with the planar section 138 in a direction away from a remainder of the body piece 126. Each of the first cavity 146 and first projection 147 have the same perimeter shape. In the example shown in FIG. 12, the perimeter shape is a trapezoid. The trapezoid of the first cavity 146 is defined by ramps 141, 142, and a portion of 143. The trapezoid of the first projection 147 is defined by ramps 144, 145, and a remainder of 143 that projects from the plane 148.

Figure 13:
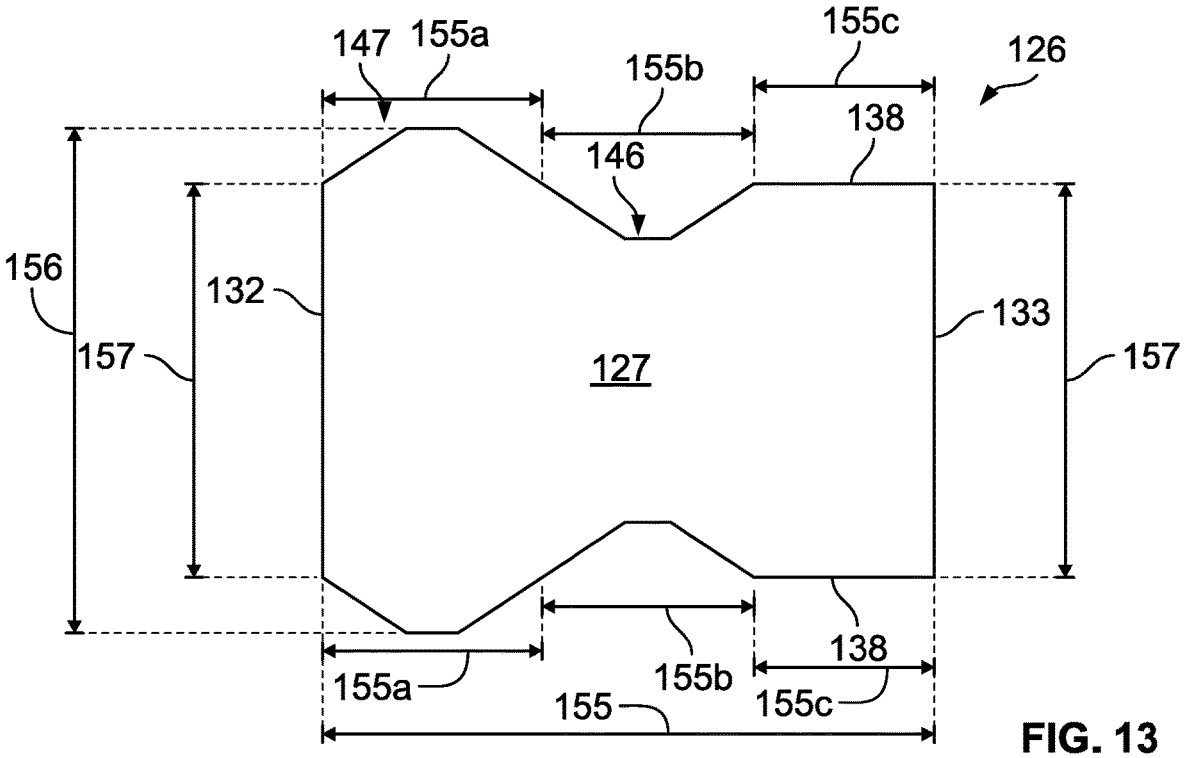
FIG. 13 is a front elevation view of the body piece of FIG. 12 and shown only the outline perimeter shape.

FIG. 13 shows the perimeter outline of body piece 126 with example dimensions. A length of the body piece 126 between the third face 132 and fourth face 133 is shown at 155 and can be at least 10 inches, no greater than 20 inches, and about 13-15 inches. The lengths 155*a*, 155*b* of the projection 147 and recess 146 respectively are at least 3 inches, no more than 7 inches, and typically about 4-6 inches. The length 155*c* of the planar section 138 will often be less than the lengths of 155*a* and 155*b*, and will be at least 2 inches, no more than 6 inches, and typically about 3-5 inches. A greatest height 156 of the body piece 126 between the peaks of the projections 147 is at least 8 inches, no greater than 22 inches, and typically about 11-12 inches. A height 157 between the planar sections is at least 6 inches, no greater than 12 inches, and typically about 8-10 inches. The thickness 158 (FIG. 22) of the body piece 126 will be as least as long as the length 155*c* of the planar section 138 and may be equal to the length 155*c* in preferred arrangements. Many alternatives are possible.

Turning again to the wall section 122 of FIG. 11, it can be seen how the wall section 122 includes base course/layer 150 of the blocks 20 arranged side by side, such that the first faces 22 are generally co-planar. Stacked on top of the base course 150 is a first course 151 of the body pieces 126. The body pieces are stacked on the base course 150 so that the planar section 138 of the sixth surface 135 of each of the body pieces 126 in the first course 151 is engaged against the sixth face 32 of the blocks 20 in the base course 150. The non-planar remainder section 139 of the sixth surface 135 of the first course 151 of body pieces 126 is in mating engagement with the remainder section 38 of the sixth face 32 of the base course 150 of the blocks 20'.

A second course 152 of the body pieces 126 is stacked on the first course 151 so that the planar section 138 of the fifth surface 134 of each of the body pieces 126 in the second course 152 is engaged against the planar section 138 of the fifth surface 134 of the body pieces 126 in the first course 151. The non-planar remainder section 139 of the fifth surface 134 of the second course 152 of body pieces 126 is in mating engagement with the non-planar remainder section 139 of the fifth surface 134 of the first course 151 of body pieces 126.

Still in reference to FIG. 11, the wall section 122 further includes a third course 154 of the blocks 20 stacked on the second course 152 of body pieces 126 so that the sixth face 32 of each of the blocks 20 in the third course 154 is engaged against the planar section 138 of the sixth surface 135 of the body pieces 126 in the second course 152. The remainder section 38 of the third course 154 of the blocks 20' is in mating engagement with the non-remainder section 139 of the sixth surface 135 of the second course 152 of body pieces 126.

It should be understood that body pieces 126 can be shaped to work with the blocks 20 of any of the various embodiments described herein and other variations within the scope of this disclosure.

C. Example Block Type and Features, FIGS. 7-9

Figure 7:
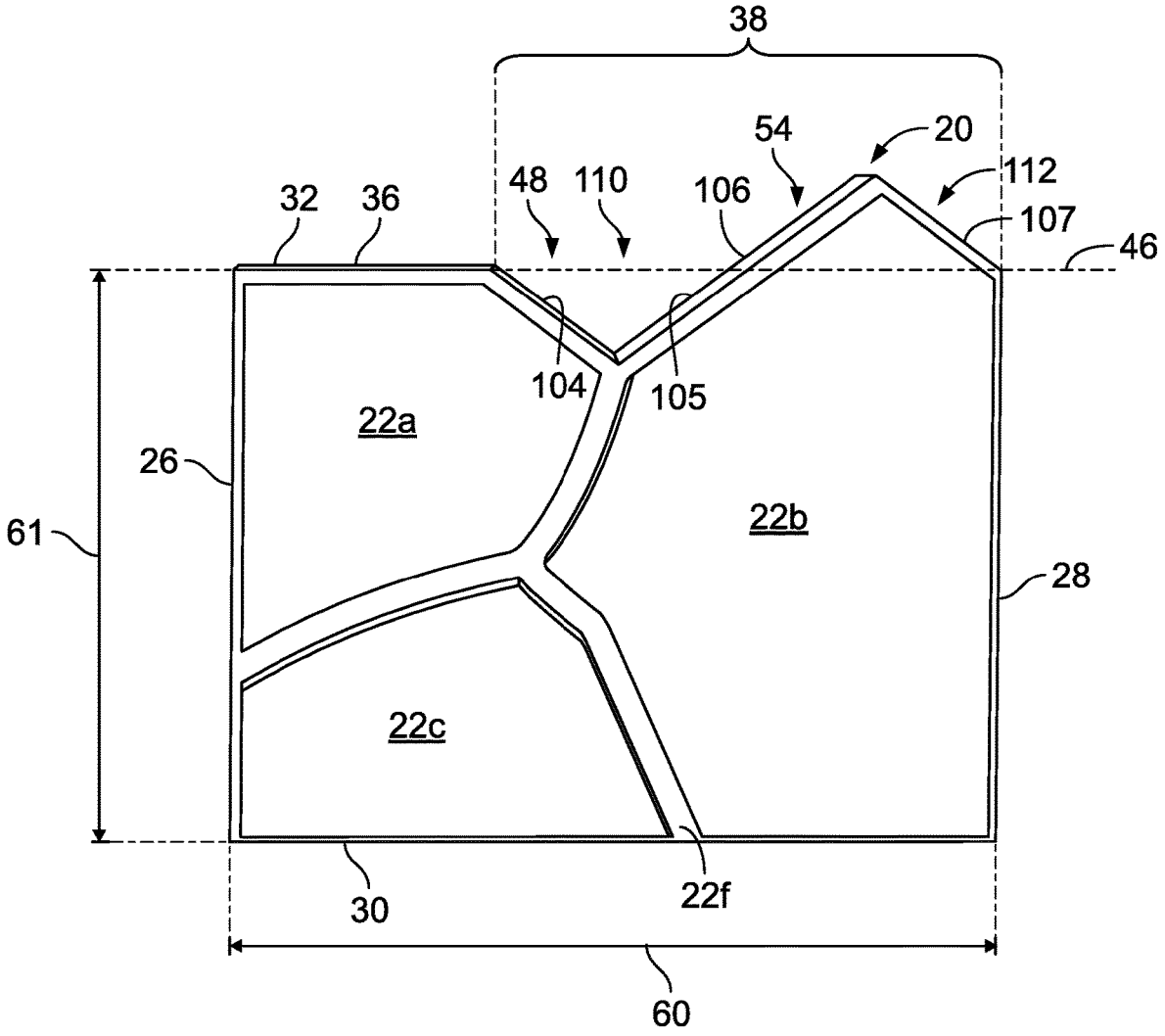
FIG. 7 is a front elevation view of another embodiment of a concrete block, constructed in accordance with principles of this disclosure.

FIG. 7 illustrates another embodiment of the block, shown here as block 20'. The same reference numerals are used for the same parts, although it should be understood that the outer perimeter has a different shape from that of the block of FIG. 2, as further described.

In this embodiment, the first cavity 48 has a perimeter shape of a triangle 110. The first projection 54 has a perimeter shape of a triangle 112. The remainder/irregular section 38 has, from left to right starting at the first section 36 of the sixth face 32: ramp 104 extending downward and away from the first section 36; ramp 105 extending upward and away from ramp 104; ramp 106 which is continuous with ramp 105; and ramp 107 extending downward and away from ramp 106 to end at fourth face 28. The first cavity 48 is defined by ramps 104, 105. The first projection 54 is defined by ramps 106, 107.

Figure 8:
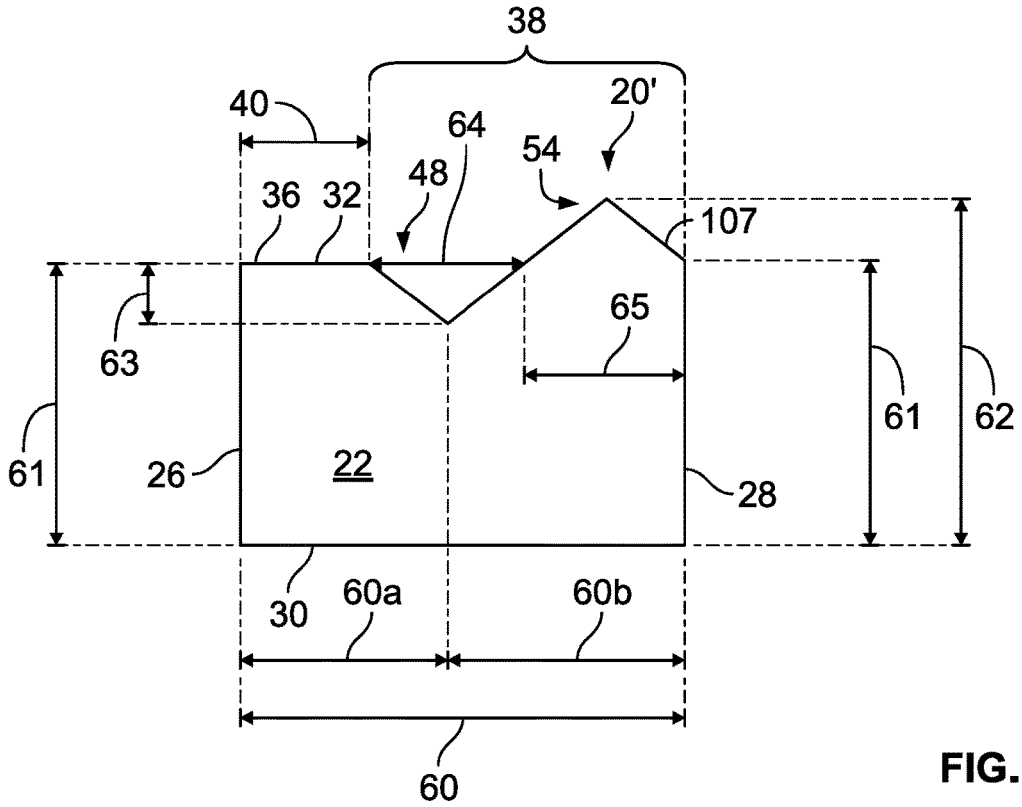
FIG. 8 is a front elevation view of the embodiment of FIG. 7 but showing only the outer perimeter shape.

In FIG. 8, the dimensions of the block 20' are illustrated. The dimensions are about the same as the dimensions shown in the FIG. 2 embodiment.

Figure 9:
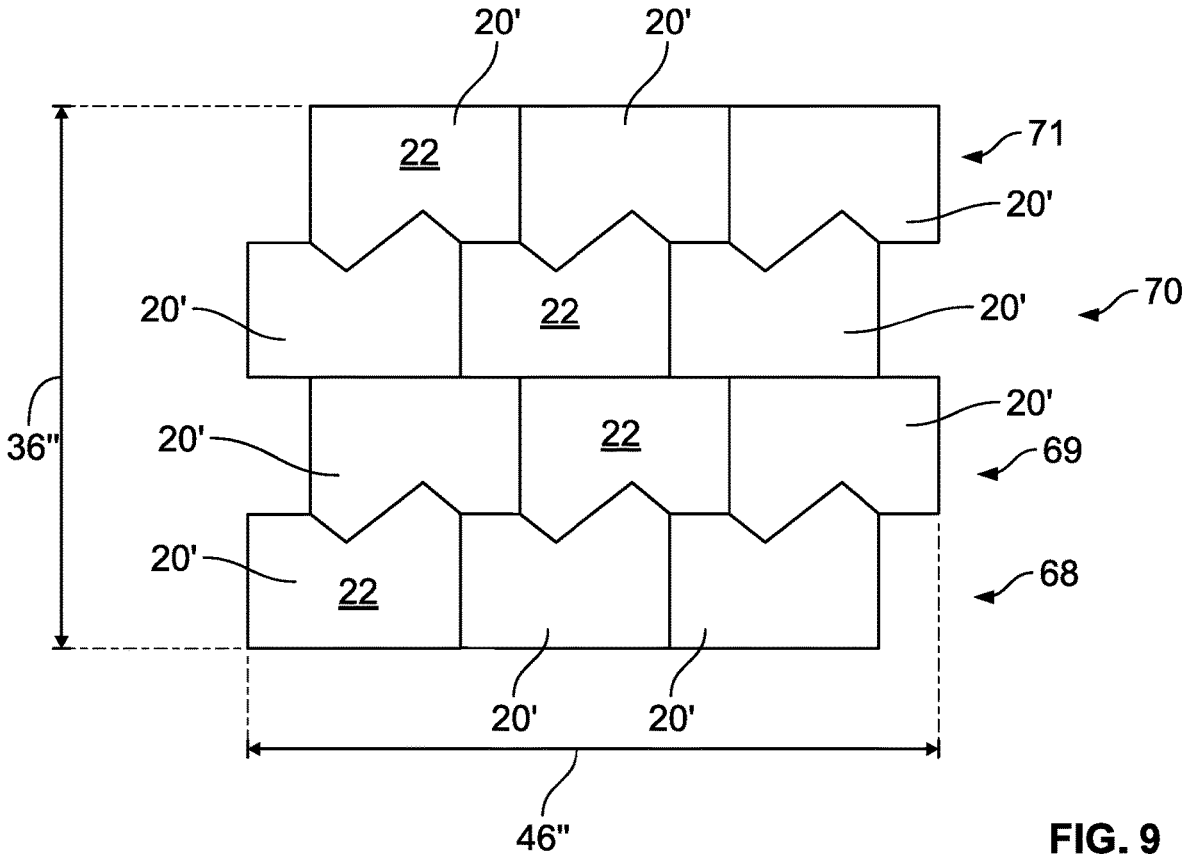
FIG. 9 is a top plan view of the block of FIG. 7 arranged on a pallet with other like blocks, and laid on the back face of the block.

In FIG. 9, the blocks 20' are illustrated as they would be laid out on a pallet, laying on their backs 24 with the first face 22 facing up. The pallet can accommodate four layers of three blocks 20' each. It can be seen how the remainder sections 38 mateably engage each other.

D. Example Block Types FIGS. 14, 15, and 19

Figure 14:
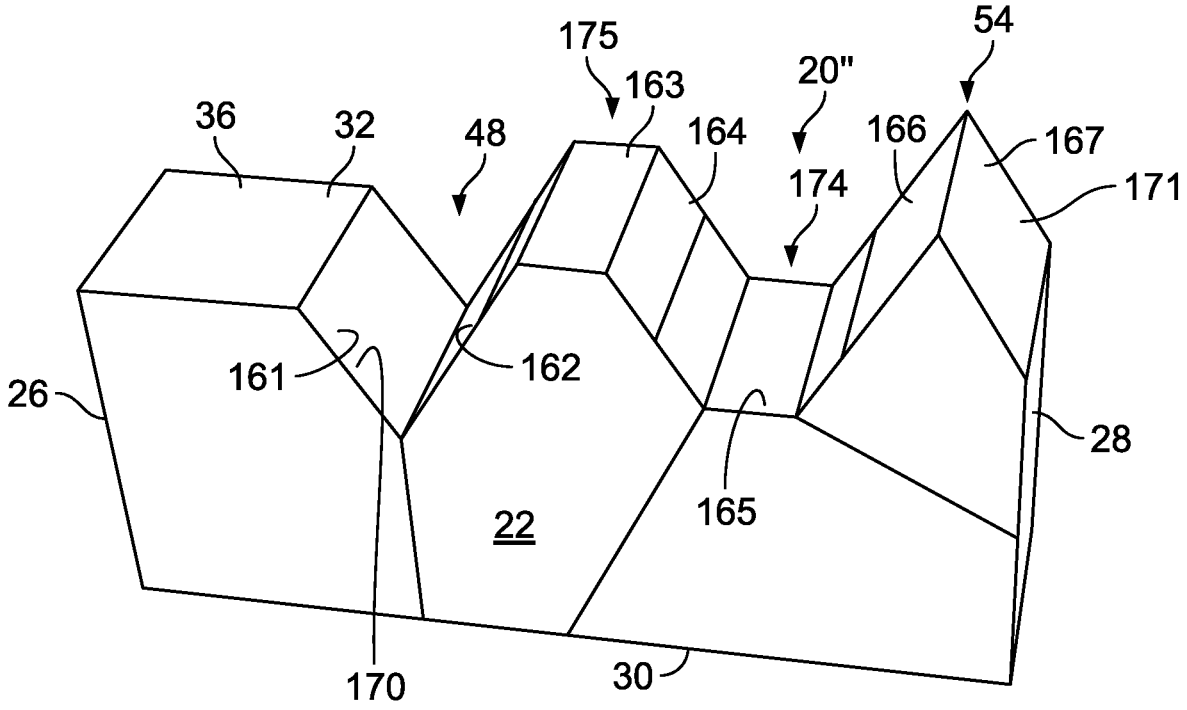
FIG. 14 is a perspective view of another embodiment of a concrete block, constructed in accordance with principles of this disclosure.

FIG. 14 illustrates another embodiment of the block, shown here as block 20". The same reference numerals are used for the same parts, although it should be understood that the outer perimeter of block 20" has a different shape from that of the block 20 of FIG. 2 and block 20' of FIG. 7, as further described.

Figure 19:
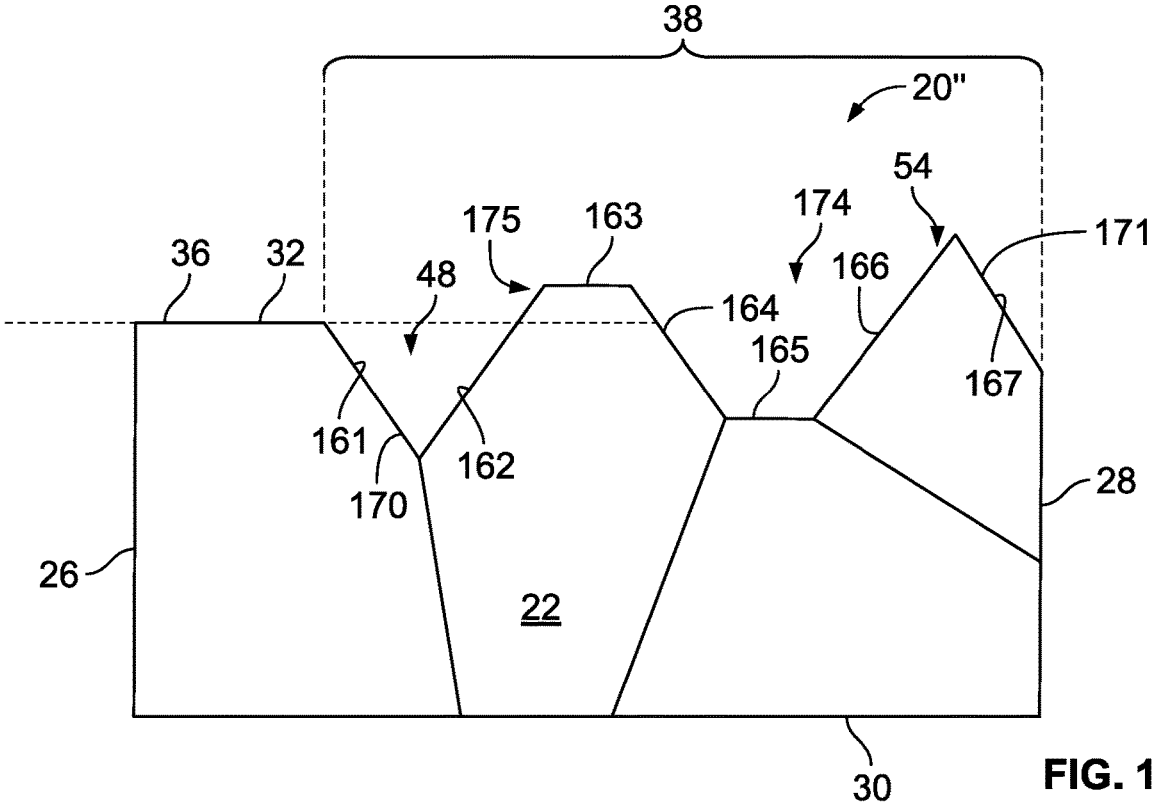
FIG. 19 is a front elevation view of the block of FIG. 14 showing the outer perimeter shape and with additional definitions.

In this embodiment, the remainder section 38 includes seven planar faces 161, 162, 163, 164, 165, 166, and 167. In FIG. 19, it can be seen how the remainder/irregular section 38 has first cavity 48 with a perimeter shape of a triangle 170, while the first projection 54 also includes a triangle perimeter shape 171.

The block 20" further includes a second cavity 174. The second cavity 174 is recessed in a direction toward the fifth face 30. There is a second projection 175 extending in a direction away from the rest of the block 20". The second cavity 174 and the second projection 175 have the same perimeter shape. In this example, the perimeter shape of the second cavity 174 and second projection 175 is trapezoidal.

The planar faces 161, 162 are angled relative to each other to form the first cavity 48. The planar faces 162, 163, and 164 form the trapezoidal shape of the second projection 175. The planar faces of 164, 165, and 166 form the trapezoid of the second cavity 174. The planar faces 166 and 167 form the perimeter shape of the first projection 54.

As can be seen in FIG. 14, the second projection 175 is between the first cavity 48 and the second cavity 174. Furthermore, the first cavity 48 and second cavity 174 alternate with the second projection 175 and first projection 54 along the irregular section 38.

Figure 15:
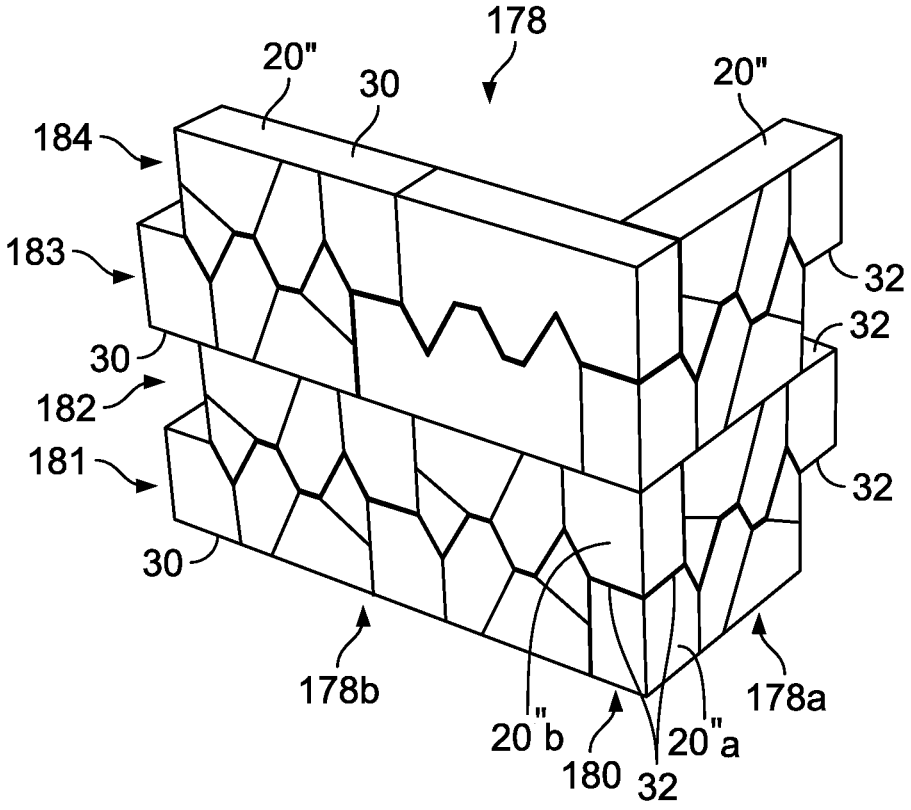
FIG. 15 is a perspective view of an embodiment of a wall with a corner construction using the block of FIG. 14.

FIG. 15 shows a wall construction 178, including wall section 178*a* and wall section 178*b* joined at a corner 180 assembled from the blocks 20". In the example shown in FIG. 15, the wall construction 178 has four layers or courses of blocks 20". It can be seen how the base course 181 is laid with the fifth/bottom face 30 against the ground surface, and the first course 182 is assembled on top of the base course 181 with the sixth face 32 pointed downwardly to mateably engage with the base course 181. The remainder sections 38 of the blocks 20" mateably engage with each other.

The second course 183 is assembled with its fifth face/bottom face 30 engaged against the fifth face/bottom 30 of the first course 182. The third course 184 is assembled on top of the second course 183 with the fifth face 30 pointed downwardly so that the remainder sections 38 mateably engage between the second course 183 and third course 184.

At the corner 180, one of the blocks 20"*a* at the corner 180 is in the base course in part of the wall construction 178*a* and is perpendicular to the wall construction 178*b*. The block 20"*a* has its sixth face 32 engaged against the sixth face 32 of block 20"*b* in the first course 182 in the wall construction 178*b*. A similar construction of the corner 180 is made between the second course 183 and third course 184.

E. Example Block Types, FIGS. 16, 17, and 20

Figure 16:
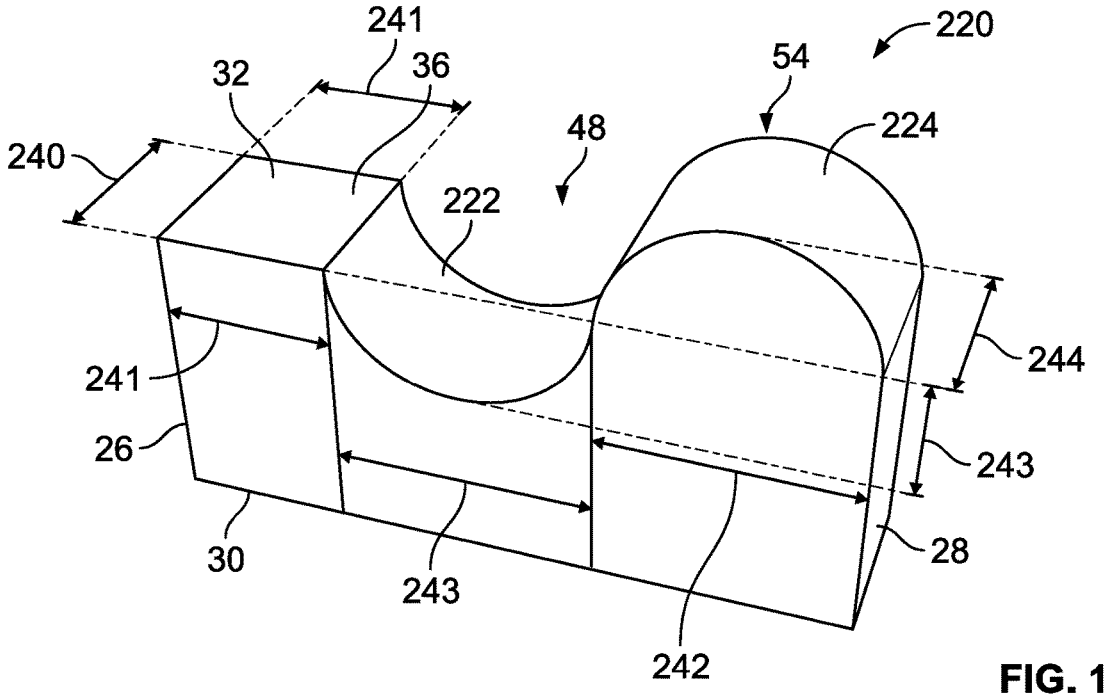
FIG. 16 is a perspective view of another embodiment of a concrete block, constructed in accordance with principles of this disclosure.
Figure 17:
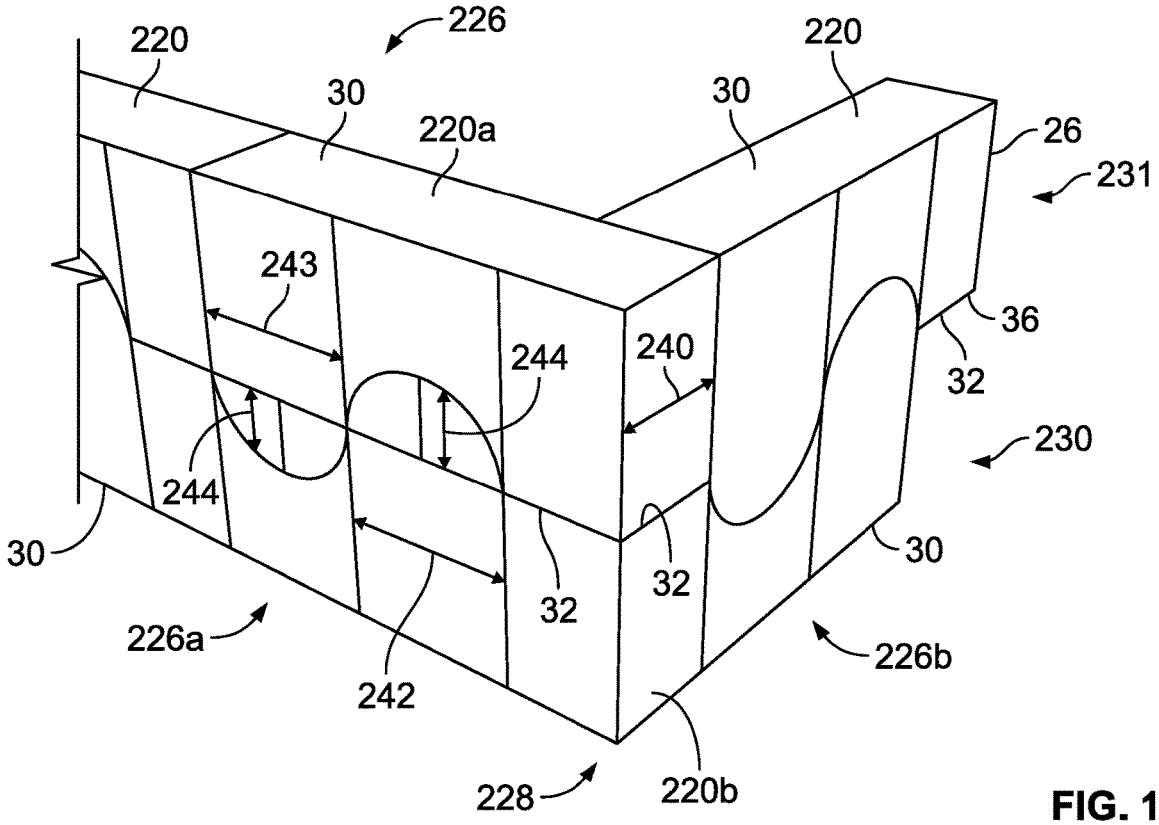
FIG. 17 is a perspective view of an embodiment of a wall with a corner construction made from the blocks of FIG. 16.
Figure 20:
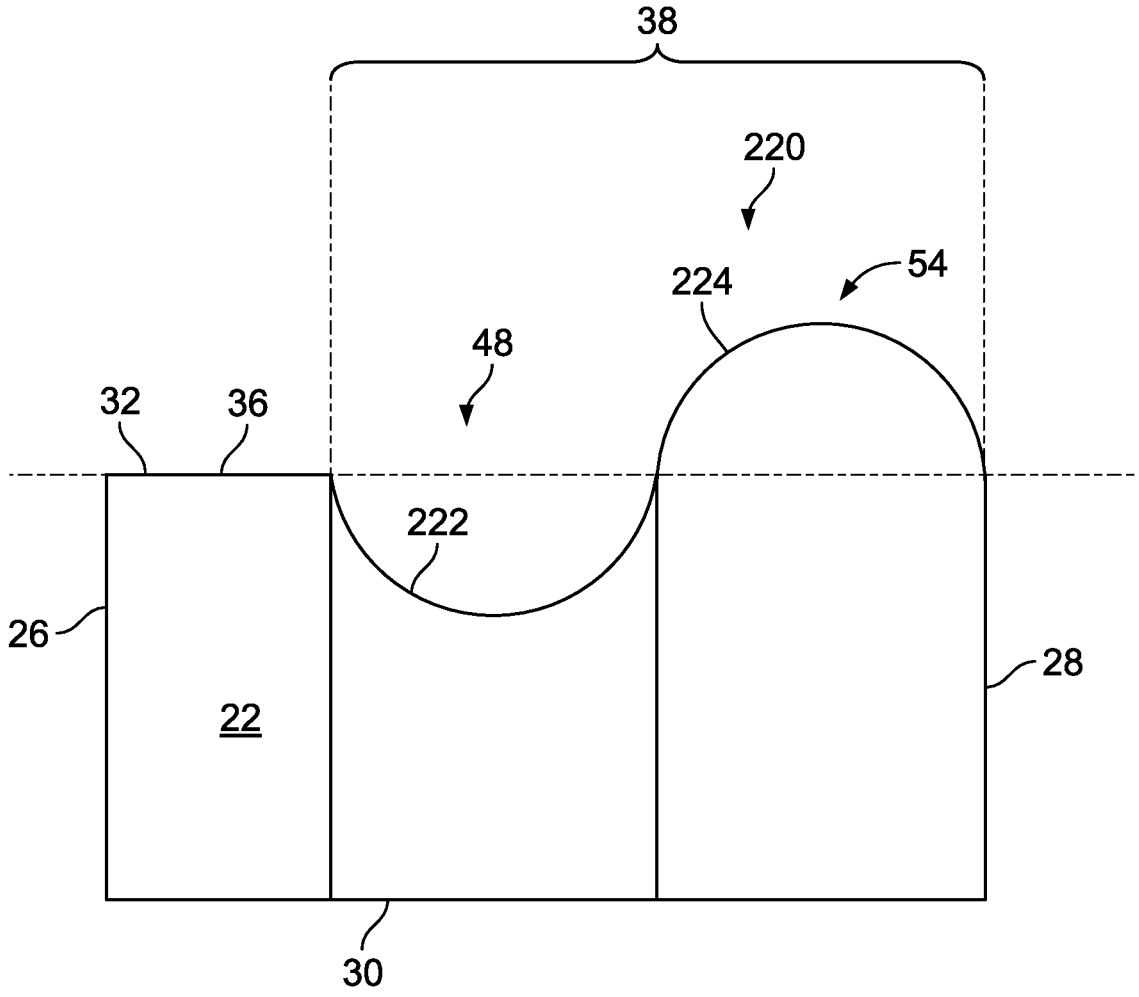
FIG. 20 is a front elevation view of the block of FIG. 16 showing an outer perimeter shape and additional definitions.

FIGS. 16, 17, and 20 illustrate another embodiment of the block shown here as block 220. The same reference numerals are used for the same parts, although it should be understood that the outer perimeter of block 220 has a different shape from that of the block 20 of FIG. 2, as further described.

In the previous embodiments, in general, the shape of the remainder section/irregular section 38 is polyhedral. In contrast, in the embodiment of FIGS. 16, 17, and 20, the perimeter shape of the remainder section 38 is curved. Some embodiments can also include a combination of both polyhedral and curved shapes for the remainder section 38.

In FIG. 16, the first cavity 48 has a perimeter that is curved, while the first projection 54 has the same shape, which is curved. The curved section of the first cavity 48 is defined by at least one concavely curved surface 222, while the first projection 54 is defined by at least one convexly curved surface 224.

Many different perimeter shapes are possible, and in the example shown, the first cavity 48 and first projection 54 are generally in the shape of semi-circles. Other shapes can includes sine-wave shapes, or any of a variety of shapes. There can be multiple curved surfaces resulting in multiple cavities and projections.

In FIG. 16, example dimensions are shown and many variations are possible. The thickness of the block 220 is shown at 240 and will be as least as long as the length 241 of the first section 36, preferably equal to the length 241, with a value of at least 4 inches, no greater than 10 inches, and typically about 5-7 inches or about 6 inches. The length 243 of the recess 48 and length 242 of the projection 54 will be equal and at least 6 inches, no greater than 12 inches, and typically about 8-10 inches or about 9 inches. The depth 243 of the recess 48 and the height 244 of the projection 54 will be equal and at least 2 inches, no greater than 8 inches, typically about 3-5 inches or about 4 inches.

In FIG. 17 is a wall construction 226 made from the blocks 220. The wall construction includes a first segment 226*a* and a second segment 226*b* joined at a corner 228.

The wall construction 226 has two courses, shown as base course 230, which is against the ground and first course or layer 231 which is against the base layer 230. The base layer 230 is made from the blocks 220 by orienting the blocks 220 with the fifth face 30 against the ground. The blocks 220 in the first section 226*a* have their first faces 22 co-planar with each other, while the blocks 220 in the second wall section 226*b* are oriented so that their first faces 22 are 90° to the first faces 22 of the blocks 220 in the first section 226*a*.

The blocks 220 in the first layer 231 are oriented upside down from the blocks in the base layer 230, so that the sixth face 32 and remainder section 38 of the blocks 220 in the first layer 231 mateably engage and are received by the remainder section 38 of the blocks 220 in the base layer 230.

At the corner 228, the sixth face 32 of the block 220*a* in the first layer 231 is engaged against the sixth face 32 of the block 220*b* in the base layer 230. The block 220*b* is in the wall construction section 226*b*, while the block 220*a* is in the wall construction section 226*a*. As such they are perpendicular to each other.

F. Example Block, FIG. 23

Figure 23:
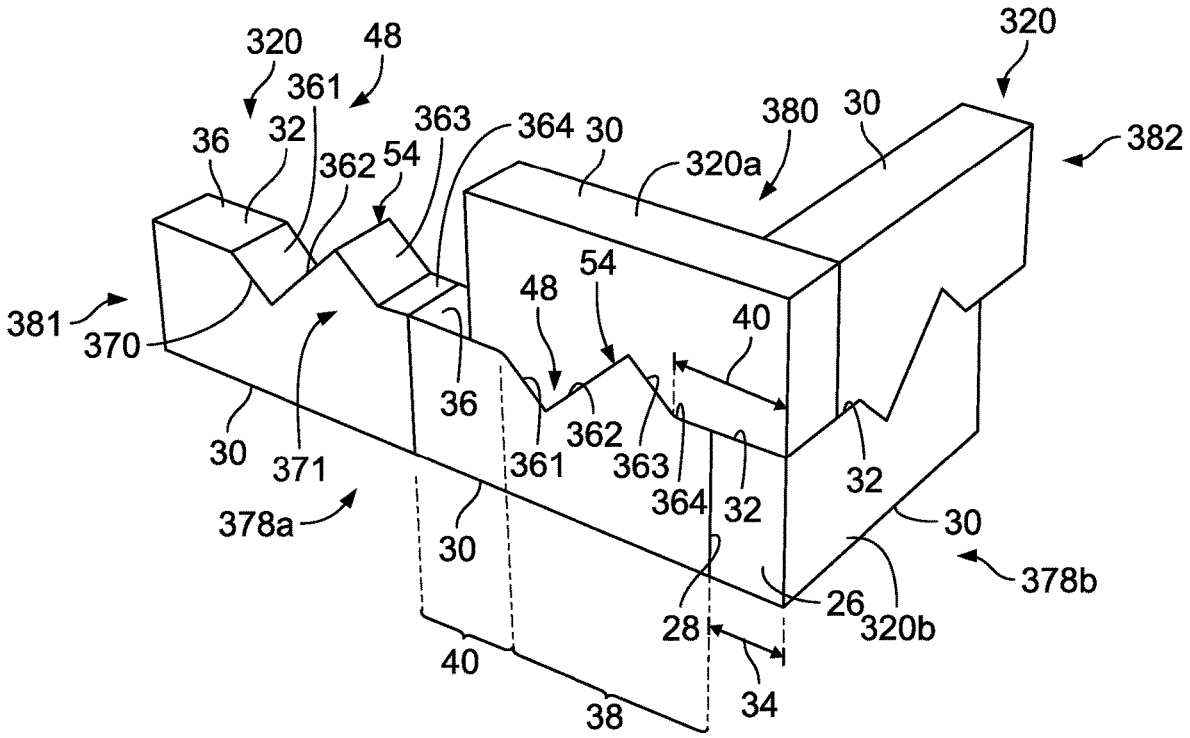
FIG. 23 is a perspective view of an assembly of blocks according to another embodiment.

FIG. 23 illustrates another embodiment of the block, shown here as block 320. The same reference numerals are used for the same parts, although it should be understood that the outer perimeter of block 320 has a different shape from that of the block 20 of FIG. 2, block 20' of FIG. 7, block 20", and block 220, as further described.

In this embodiment, the remainder section 38 includes four planar faces 361, 362, 363, 364. In FIG. 23, it can be seen how the remainder/irregular section 38 has first cavity 48 with a perimeter shape of a triangle 370, while the first projection 54 also includes a triangle perimeter shape 371.

The planar faces 361, 362 are angled relative to each other to form the first cavity 48. The planar faces 362, 363 form a triangular perimeter shape of the first projection 54. Extending from a base of the first projection 54, at an end of the face 363 is the planar face 364 extending to the fourth face 28. The planar face 364 is generally parallel to the fifth (bottom) face 30. In preferred embodiments, the planar face 364 is co-planar with the first section 36 of the sixth (upper) face 32.

In this embodiment, the first section 36 has a length 40 from the third face 36 to the remainder section 38 at least as long as the thickness 34 of the block 320. In the example shown in this embodiment, the length 40 of the first section 36 is greater than the thickness 34 of the block 320.

FIG. 23 shows a wall construction 378, including wall section 378*a* and wall section 378*b* joined at a corner 380 assembled from the blocks 320. In the example shown in FIG. 23, the wall construction 378 has two layers or courses of blocks 320. It can be seen how the base course 381 is laid with the fifth/bottom face 30 against the ground surface, and the first course 382 is assembled on top of the base course 381 with the sixth face 32 pointed downwardly to mateably engage with the base course 381. The remainder sections 38 of the blocks 320 mateably engage with each other.

At the corner 380, one of the blocks 320*b* at the corner 380 is in the base course in part of the wall construction 378*b* and is perpendicular to the wall construction 378*a*. The block 320*b* has its sixth face 32 engaged against the sixth face 32 of block 320*a* in the first course 382 in the wall construction 378*a*.

G. Example Methods

A variety of structures can be constructed from the blocks described herein with methods as generally described above. The methods generally include laying out the base course of the blocks, and arranging a first course on top of the base course in such a way that the first course is oriented so that the remainder section of the first course is against and mateably engaged with the remainder section of the base course. Corners can be constructed due to the length of the first section of the sixth face being as least as long as the thickness of the block as defined by the distance between the front and back faces. The result of this geometry is that a corner is made by the sixth face of one of the blocks in the first course and at the end of a wall section perpendicular to a first wall section is engaged against the sixth face of one of the blocks at the corner section and of the wall perpendicular to it in the base layer.

The above represents example principles. Many embodiments can be made using these principles.

What is claimed is:

1. A first block comprising first, second, third, fourth, fifth, and sixth planar faces, wherein;

(a) the first and second faces are generally parallel, and the distance between the first and second faces defines the thickness of the first block;

(b) the third and fourth faces are parallel to each other and perpendicular to the first and second faces;

(i) at least the first face, third face, and fourth face has false joint lines thereon;

(c) the fifth face is perpendicular to the first, second, third, and fourth faces;

(d) the sixth face:

(i) extends perpendicular to the third face;

(ii) extends toward the fourth face and ends at a non-planar remainder section;

(iii) is parallel to the fifth face; and (iv) is contained in a plane that intersects a plane containing the third face; a distance from the intersection to the remainder section being at least as long as the thickness of the first block; and (e) the remainder section extends between the sixth face and the fourth face and has a shape to receive a remainder section of a second block having a same shape as the first block.

2. The first block of claim 1 wherein the remainder section includes a plurality of planar faces angled relative to each other at non-straight and non-zero angles.

3. The first block of claim 2 wherein the plurality of planar faces of the remainder section includes at least three planar faces.

4. The first block of claim 2 wherein the plurality of planar faces of the remainder section includes at least five planar faces.

5. The first block of claim 1 wherein the remainder section includes a curved surface.

6. The first block of claim 5 wherein the curved surface includes at least one convexly curved surface and at least one concavely curved surface.

7. The first block of claim 1 wherein the length from the third face to the remainder section is equal to the thickness of the first block.

8. The first block of claim 1 wherein the length from the third face to the remainder section is greater than the thickness of the first block.

9. A concrete construction block comprising:

a first planar face;

a second planar face spaced from the first face; the block having a thickness defined by a distance between the first face and second face;

a third planar face extending between the first and second faces;

a fourth planar face spaced from the third face; the fourth face extending between the first and second faces;

a fifth planar face extending between the first face, second face, third face, and fourth face;

a sixth planar face, spaced from the fifth face; the sixth face extending between the first face, second face, and third face and being contained within a plane extending from a plane containing the third face a distance as least as long as said thickness of the block;

an irregular section extending from the sixth face to the fourth face and between the first face and second face;

the irregular section including at least a first cavity and a first projection;

the first cavity being recessed from an imaginary plane in a direction toward the fifth face; said plane being co-planar with the sixth face;

the first projection extending from said plane in a direction away from a remainder of the block; and the first cavity and the first projection having a same first perimeter shape.

10. The block of claim 9 wherein the irregular section further includes a second cavity and second projection;

the second cavity being recessed from the imaginary plane in a direction toward the fifth face;

the second projection extending from said imaginary plane in a direction away from a remainder of the block; and the second cavity and the second projection having a same second perimeter shape.

11. The block of claim 10 wherein the second projection is between the first cavity and second cavity.

12. The block of claim 10 wherein the first and second cavities alternate with the first and second projections along the irregular section.

13. The block of claim 9 wherein said perimeter first shape is curved.

14. The block of claim 9 wherein said perimeter first shape is polyhedral.

15. The block of claim 10 wherein:

(a) said perimeter first shape is polyhedral; and (b) said perimeter second shape is polyhedral.

16. The first block of claim 9 wherein at least the first and second faces have false joint lines thereon.

17. The first block of claim 16 wherein the third and fourth faces have false joint lines thereon.

18. The first block of claim 9 wherein the sixth face extends from the third face a distance equal to said thickness of the block.

19. The first block of claim 9 wherein the sixth face extends from the third face a distance greater than said thickness of the block.

* * * * *